US009250607B2

(12) United States Patent
Fukui et al.

(10) Patent No.: US 9,250,607 B2
(45) Date of Patent: Feb. 2, 2016

(54) IMAGE FORMING APPARATUS AND CARTRIDGE

(71) Applicant: CANON KABUSHIKI KAISHA, Tokyo (JP)

(72) Inventors: Yuichi Fukui, Yokosuka (JP); Noritomo Yamaguchi, Kawasaki (JP); Masaaki Sato, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/096,379

(22) Filed: Dec. 4, 2013

(65) Prior Publication Data

US 2014/0161483 A1 Jun. 12, 2014

(30) Foreign Application Priority Data

Dec. 10, 2012 (JP) ..... 2012-269259

(51) Int. Cl.
*G03G 15/00* (2006.01)
*G03G 21/18* (2006.01)
*G03G 21/16* (2006.01)

(52) U.S. Cl.
CPC ..... *G03G 21/1842* (2013.01); *G03G 21/1623* (2013.01); *G03G 21/1676* (2013.01)

(58) Field of Classification Search
CPC ..... G03G 15/0865; G03G 15/0889; G03G 21/1676; G03G 15/08; G03G 15/0832; G03G 15/0834; G03G 15/0836; G03G 15/0837; G03G 15/0839; G03G 15/0886; G03G 15/1665; G03G 15/1695; G03G 15/2017
See application file for complete search history.

(56) References Cited

U.S. PATENT DOCUMENTS

| | | | | |
|---|---|---|---|---|
| 5,802,433 | A | 9/1998 | Sato et al. | |
| 2011/0299873 | A1* | 12/2011 | Ushiozu et al. | 399/90 |
| 2012/0027457 | A1* | 2/2012 | Yamaguchi et al. | 399/111 |
| 2013/0108316 | A1 | 5/2013 | Sato et al. | |

FOREIGN PATENT DOCUMENTS

| | | | |
|---|---|---|---|
| JP | 2006-184901 | A | 7/2006 |
| JP | 2009-157389 | A | 7/2009 |

* cited by examiner

*Primary Examiner* — Roy Y Yi
(74) *Attorney, Agent, or Firm* — Fitzpatrick, Cella, Harper & Scinto

(57) ABSTRACT

An image forming apparatus loadable with a cartridge includes a supporting member, carrying the cartridge, movable between an inside position and an outside position. The supporting member is provided with a first regulating portion to limit the cartridge in one of the longitudinal directions and a second regulating portion to limit movement of the cartridge in the other longitudinal directions. In addition, a third regulating portion limits the supporting member in the one longitudinal direction, and a fourth regulating portion limits the supporting member in the other longitudinal direction. The first, second, third and fourth regulating portions are all provided at the one longitudinal end portion side and outside an image forming region.

33 Claims, 14 Drawing Sheets

(a)

ONE SIDE (b) THE OTHER SIDE

IMAGE FORMING APPARATUS AND CARTRIDGE

FIELD OF THE INVENTION AND RELATED ART

The present invention relates to an image forming apparatus for forming an image on a recording material and a cartridge therefor.

The image forming apparatus forms an image on a recording material using a known image formation principle such as an electrophotographic process, an electrostatic recording process or a magnetic recording process. For example, it is a copying machine, a printer (laser beam printer, LED printer, for example), a facsimile machine, a word processor, an image display device (electronic blackboard or electronic white board), or the like. The recording material is a material on which the image is formed by the image forming apparatus, and is a paper sheet, an OHT sheet, an image display member or the like.

The cartridge comprises an image bearing member on which the image is formed, and image forming process means (a part or all of an image forming means) actable on the image bearing member, which are unified into a cartridge. It is dismountably mounted to a main assembly of the image forming apparatus to contribute the image forming process for forming an image on the recording material. The main assembly of the apparatus of the cartridge type is structural portions of the image forming apparatus excluding the cartridge.

The image bearing member may be an electrophotographic photosensitive member in the electrophotographic process, a dielectric member for electrostatic recording in the electrostatic recording process, a magnetic member for magnetic recording in the magnetic recording process, or an image bearing member in another image forming process. The image forming process means is means for forming an image on the image bearing member.

A cartridge type electrophotographic image forming apparatus will be taken as an example. The cartridge may be a process cartridge or a developing cartridge, for example.

The process cartridge comprises an electrophotographic photosensitive member, and at least one of charging means, developing means and cleaning means as the electrophotographic process means, which are unified into a cartridge dismountably mountable to the main assembly of the electrophotographic image forming apparatus.

Therefore, the process cartridge may comprise the electrophotographic photosensitive member and the developing means as the process means which are unified into a cartridge dismountably mountable to the main assembly of the apparatus. The process cartridge may comprise the electrophotographic photosensitive member, and the charging means, the developing means or the cleaning means as the process means, which are unified into a cartridge dismountably mountable to the main assembly of the apparatus.

The process cartridge comprising the electrophotographic photosensitive member and the developing means as a unit is called integral type cartridge. On the other hand, the process cartridge comprising the electrophotographic photosensitive member and a process means other than the developing means, as a unit, is called separation type. In such a case, the developing means is provided in a developing unit which is separate from the process cartridge and contributes the image formation with the process cartridge.

Using the process cartridge types, the maintenance operation of the image forming apparatus can be carried out by the user without relying on a service person, in effect, and therefore, the operationality can be improved remarkably.

The developing cartridge includes the developer carrying member (developing roller) for applying a developer to the electrophotographic photosensitive member. It also includes powdery developer (toner) for developing an electrostatic latent image formed on the electrophotographic photosensitive member by the developing roller, and it is dismountably mounted to the main assembly of the apparatus.

In the case when the developing cartridge is used, the electrophotographic photosensitive member is mounted to the main assembly of the apparatus or to a cartridge supporting member. Or, the electrophotographic photosensitive member is provided in the separable type process cartridge (in this case, the process cartridge is not provided with the developing means). The developing cartridge can be mounted to or dismounted from the main assembly of the apparatus by the user. Therefore, the maintenance of the main assembly of the apparatus can be carried out easily, in effect.

The cartridge may be the above-described integral type or separable type. In addition, the cartridge may be constituted by a combination of the separable type process cartridge and the developing cartridge. The cartridge may be a developing cartridge detachably mountable to act on the electrophotographic photosensitive member stationarily provided in the main assembly of the apparatus or on the cartridge supporting member. The cartridge may be a unit dismountably mountable to the main assembly of the apparatus and contributable to the image forming process for forming an image on the recording material.

As to a structure for mounting and demounting the cartridge in such a cartridge type image forming apparatus, Japanese Laid-open Patent Application 2006-184901) discloses a type in which a supporting member supporting the cartridge is drawn out, and the cartridge is mounted and demounted.

In such a type, during transportation of the image forming apparatus with the cartridge mounted to the main assembly of the apparatus, the supporting member and the cartridge supported by the supporting member may shake with the possible result that a significant impact is imparted to the supporting member and the cartridge. In order to avoid this, it is required to enhance the rigidity so as to prevent the damage of the parts of the supporting member and/or the cartridge, and doing so would result in the upsizing and increase in cost of the cartridge and the main assembly of the apparatus.

SUMMARY OF THE INVENTION

Accordingly, it is a principal object of the present invention to provide an image forming apparatus and a cartridge with which parts of the supporting member and the cartridge are simplified by reducing the impact imparted to the supporting member and the cartridge during the transportation in the case that the image forming apparatus is shipped with the cartridge mounted in the main assembly of the apparatus. By this, the main assembly of the apparatus and the cartridge can be downsized and decreased in cost.

According to an aspect of the present invention, there is provided an image forming apparatus to which a cartridge is detachably mountable, said image forming apparatus comprising: a supporting member movable, carrying said cartridge, in directions crossing with a longitudinal direction of said cartridge, between an inside position in which said supporting member is inside a main assembly of said image forming apparatus and an outside position in which said supporting member is outside said main assembly of the apparatus and in which said cartridge is detachably mountable to said main assembly of the apparatus, said supporting member being provided with a first regulating portion capable of being contacted by said cartridge mounted to said supporting member to limit movement of said cartridge in one of the longitudinal directions and a second regulating portion capable of being contacted by said cartridge mounted to said supporting member to limit movement of said cartridge in the other one of the longitudinal directions; a third regulating portion provided in said main assembly of the apparatus to be contacted by said supporting member to limit movement of said supporting member in the one longitudinal direction; and a fourth regulating portion provided in said main assembly of the apparatus to be contacted by said supporting member to limit movement of said supporting member in the other longitudinal direction; wherein said first regulating portion, said second regulating portion, said third regulating portion and said fourth regulating portion are provided at one longitudinal end portion side and outside an image forming region.

According to another aspect of the present invention, there is provided a cartridge detachably mountable to a supporting member of an image forming apparatus, wherein the image forming apparatus includes the supporting member movable, carrying said cartridge, in directions crossing with a longitudinal direction of said cartridge, between an inside position in which said supporting member is inside a main assembly of said image forming apparatus and an outside position in which said supporting member is outside said main assembly of the apparatus and in which said cartridge is detachably mountable to said main assembly of the apparatus, said supporting member being provided with a first regulating portion capable of being contacted by said cartridge mounted to said supporting member to limit movement of said cartridge in one of the longitudinal directions and a second regulating portion capable of being contacted by said cartridge mounted to said supporting member to limit movement of said cartridge in the other one of the longitudinal directions, said cartridge comprising a first portion-to-be-regulated contactable to said first regulating portion so that movement of said cartridge in one of the longitudinal directions, when said cartridge is mounted to said supporting member; and a second portion-to-be-regulated contactable to said second regulating portion so that movement of said cartridge in the other one of the longitudinal directions, when said cartridge is mounted to said supporting member.

According to a further aspect of the present invention, there is provided an image forming apparatus for forming an image on a recording material comprising a cartridge provided with a first portion-to-be-regulated and a second portion-to-be-regulated; a supporting member movable, carrying said cartridge, in directions crossing with a longitudinal direction of said cartridge, between an inside position in which said supporting member is inside a main assembly of said image forming apparatus and an outside position in which said supporting member is outside said main assembly of the apparatus and in which said cartridge is detachably mountable to said main assembly of the apparatus, said supporting member being provided with a first regulating portion capable of being contacted by said first portion-to-be-regulated to limit movement of said cartridge in one of the longitudinal directions and a second regulating portion capable of being contacted by said second portion-to-be-regulated to limit movement of said cartridge in the other one of the longitudinal directions; a third regulating portion for being contacted by said supporting member to limit movement of said supporting member in the one longitudinal direction; and a fourth regulating portion for being contacted by said supporting member to limit movement of said supporting member in the other longitudinal direction; wherein said first regulating portion, said second regulating portion, said third regulating portion and said fourth regulating portion are provided at the one longitudinal end portion side and outside an image forming region.

Further features of the present invention will become apparent from the following description of exemplary embodiments with reference to the attached drawings.

These and other objects, features and advantages of the present invention will become more apparent upon a consideration of the following description of the preferred embodiments of the present invention taken in conjunction with the accompanying drawings.

DESCRIPTION OF THE EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated. In the following descriptions, functions, materials, configurations and so on of the elements once described are the same as those of the previous description unless otherwise stated.

Embodiment 1

A first embodiment of the present invention will be described. In this embodiment, the image forming apparatus is used with four integral type detachably mountable process cartridges. The number of the mountable process cartridges is not limited to four. It is selected in accordance with the necessity. In this embodiment, the image forming apparatus is a printer.

[General Arrangement of the Example of the Image Forming Apparatus]

Figure 2:
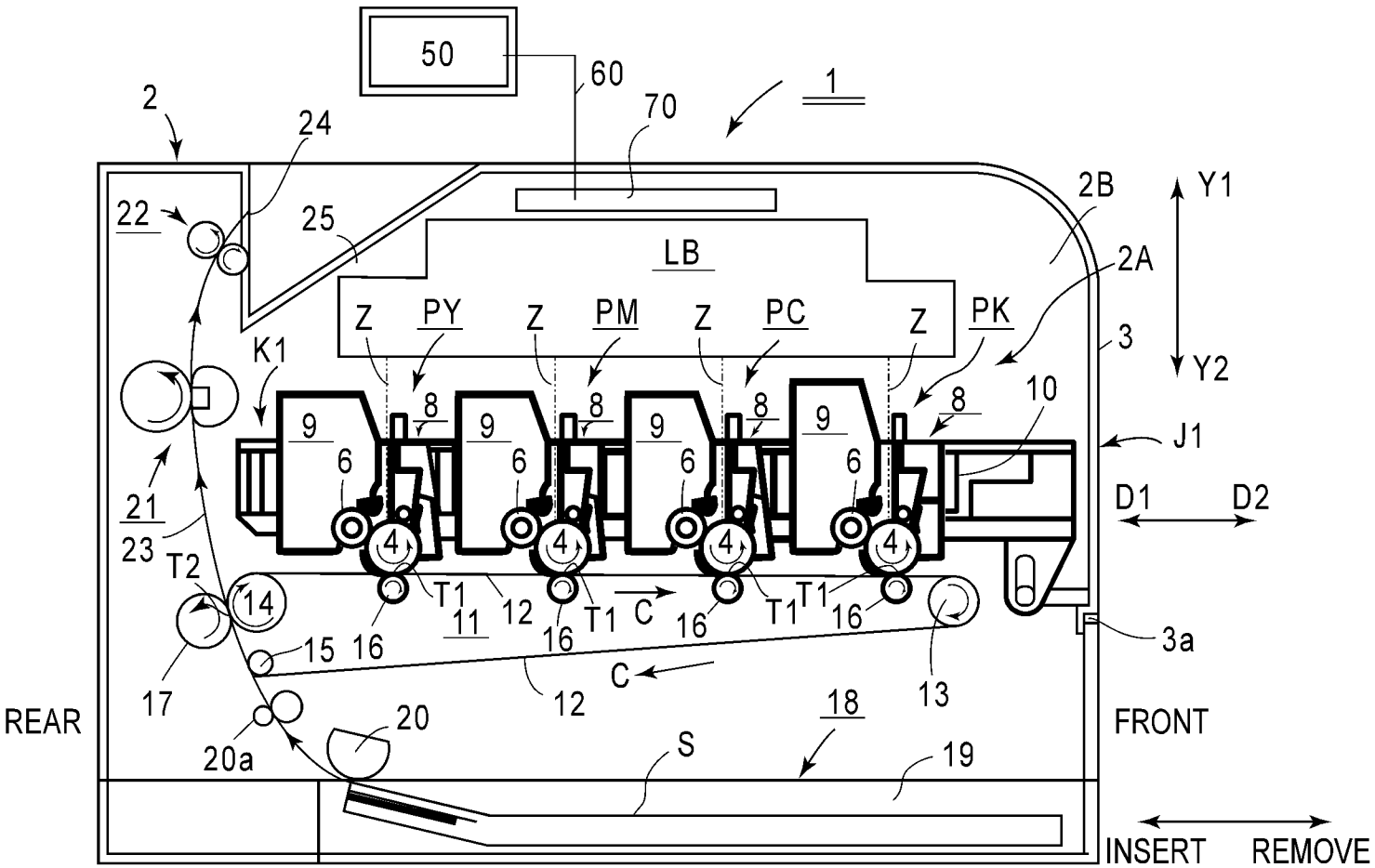
FIG. 2 is a schematic section of the image forming apparatus according to the first embodiment.

FIG. 2 is a schematic section of the image forming apparatus 1 of this embodiment. The image forming apparatus 1 is a four full-color laser beam printer using an electrophotographic process. An electrical image signal supplied from an external host apparatus 50 such as a personal computer, an image reader is inputted to a controller (CPU) 70 through an interface 60, and on the basis of the image signal, a full-color image or a monochromatic image is formed on a sheet-like recording material S as a recording material.

The image forming apparatus 1 is a cartridge type apparatus loadable with four integral type process cartridges P (PY, PM, PC, PK).

Here, a front side is a side provided with a prior door (openable member) 3. One end portion side is outside of an image forming region at the left as seen from the front side of the image forming apparatus 1. Other end portion side is outside of an image forming region at the right as seen from the front side of the image forming apparatus 1. In this embodiment, the one end portion side is a non-driving side, and the other end portion side is a driving side. A frontward direction is a direction from a rear side toward the front side, and a backward direction is a direction from the front side direction the rear side. In addition, up and down are based on the direction of the gravity.

FIG. 2 is a longitudinal sectional view of the image forming apparatus 1 as seen from one end portion side (right-hand side view of the longitudinal section). Therefore, in FIG. 2, the front side of the sheet of the drawing is the one end portion side of—the image forming apparatus 1 (non-driving side); the rear side of the sheet of the drawing is the other end portion side of—the image forming apparatus 1 (driving side); the right side of the sheet of the drawing is the front side of the image forming apparatus 1; and the left side of the sheet of the drawing is the rear side of the image forming apparatus 1.

Inside the main assembly 2 of the apparatus, there is provided a cartridge accommodating portion 2A. In the cartridge accommodating portion 2A, the first to fourth process cartridges PY, PM, PC, PK are arranged in the horizontal direction from the rear side toward the front side of the main assembly 2 of the apparatus in the predetermined mounting positions (in-line tandem).

In the mounting position of the cartridge P, the cartridge P is capable of carrying out the image forming operation in the cartridge accommodating portion 2A. In the mounting position, each cartridge P receives a rotational force from a drive outputting portion of the main assembly 2 of the apparatus during the image forming operation. In addition, it receives a predetermined bias voltages (charging bias voltage, developing bias voltage or the like) from the main assembly 2 of the apparatus.

Figure 3:
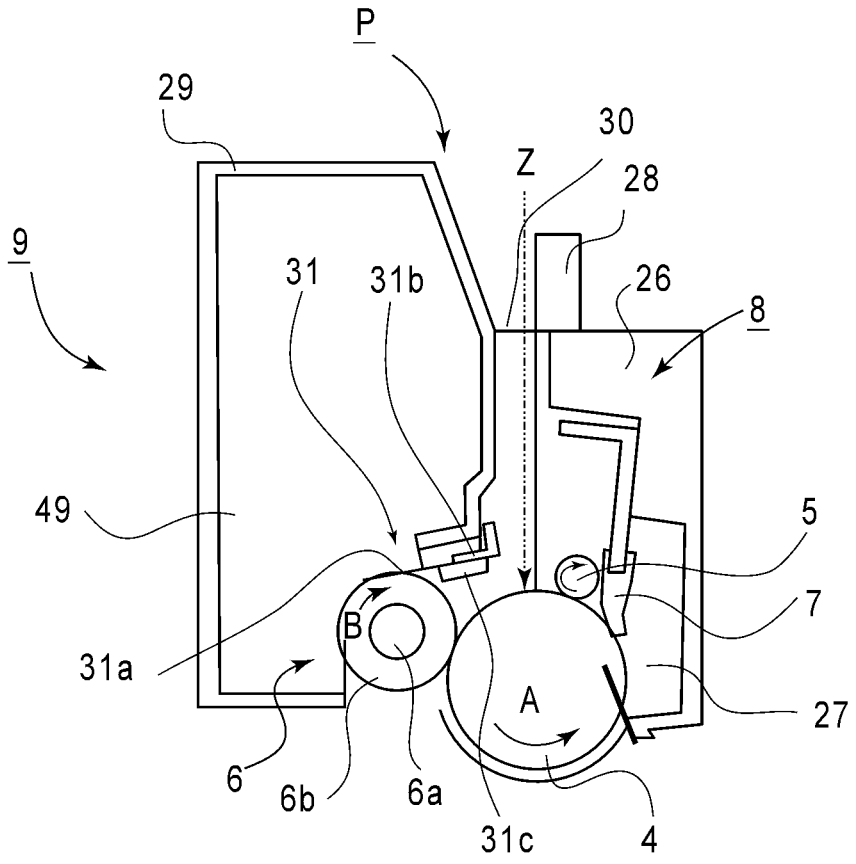
FIG. 3 is a sectional view of a process cartridge according to the first embodiment.

The cartridge P is contributable to the image forming process for forming the image on the recording material S and is detachably mounted to the main assembly 2 of the apparatus. FIG. 3 is an enlarged view of one of the cartridges P shown in FIG. 2. An exchanging system of the cartridges P will be described hereinafter.

Each cartridge P in this embodiment is an integral type process cartridge including a similar electrophotographic processing mechanism, but the toner (developer) color and/or the toner amount is different from each other.

Each cartridge P comprises a drum type electrophotographic photosensitive member (drum) 4 as an image bearing member on which a latent image is formed. The integral type process cartridge further comprises charging means 5, developing means 6 and cleaning means 7 as the image forming process means actable on the drum 4. In this embodiment, the charging means 5 includes a charging roller, the developing means 6 includes a developing roller, and the cleaning means 7 includes a cleaning blade. Further detail of the structure of the cartridge P will be described hereinafter.

The first cartridge PY contains yellow (Y) toner in the toner accommodating portion (developer accommodating portion) 49 of a developing device frame 29 and forms a Y color toner image on the surface of the drum 4. The second cartridge PM contains magenta (M) toner in a toner accommodating portion 49 and forms a M color toner image on the surface of the drum 4. The third cartridge PC contains cyan (C) toner in a toner accommodating portion 49 and forms a cyan color toner image on the surface of the drum 4. The fourth cartridge PK contains black (K) toner in a toner accommodating portion 49 and forms a K color toner image on the surface of the drum 4.

Above the cartridge accommodating portion 2A, there is provided a laser scanner unit LB as exposure means. The unit LB outputs a laser beam Z corresponding to the information of the color component of the image information inputted to a controller 70 from an external host apparatus 50. The laser beams Z scans the surface of the drum 4 through an exposure window 30 of the cartridge P.

Below the cartridge accommodating portion 2A, there is provided an intermediary transfer belt unit 11 as a transfer member. The unit 11 comprises a driving roller 13, a turning roller 14, a tension roller 15 and a flexible intermediary transfer belt (belt) stretched around the rollers. The turning roller 14 and the tension roller 15 are disposed in the rear side in the main assembly 2 of the apparatus. The driving roller 13 is disposed in the front side in the main assembly 2 of the apparatus.

In the state that the cartridge P is in the predetermined mounting position, the lower surface of each drum 4 contacts an upper part of the belt 12. The contact portion is a primary transfer portion T1. Inside the belt 12, a primary transfer roller 16 is provided opposed to the lower surface of each drum 4 through the belt 12. To the turning roller 14, a secondary transfer roller 17 is urged through the belt 12. The contact portion between the belt 12 and the secondary transfer roller 17 is a secondary transfer portion T2.

Below the intermediary transfer belt unit 11, there is provided a feeding unit 18. The feeding unit 18 comprises a sheet feeding tray 19 for accommodating a stack of the recording materials S. The sheet feeding tray 19 is mounted and demounted from the front side of the main assembly 2 of the apparatus relative to the main assembly 2 of the apparatus (front loading type).

In the rear side in the main assembly 2 of the apparatus, there is provided an upper feeding path 23 toward an upper discharge opening 24 from the sheet feeding roller 20. A registration roller unit 20*a* is provided between the sheet feeding roller 20 of the feeding path 23 and the secondary transfer portion T2. Between the secondary transfer portion T2 and the discharge opening 24, a fixing unit 21 and a discharging unit 22 are provided in the order named. The upper surface of the main assembly 2 of the apparatus functions as a discharging tray 25.

[Image Forming Operation]

The operations for forming a full-color image will be described. The drums 4 of the first-fourth cartridges PY, PM, PC, PK are rotated at a predetermined speed in a direction indicated by an arrow A in FIG. 3. The belt 12 is also rotated at the speed corresponding to the speed of the drum 4 codirectionally with the rotation of the drum 4. The laser scanner unit LB is also driven.

In synchronism with the unit LB, the charging roller 5 uniformly charges the surface of the drum 4 to the predetermined polarity and potential. The charging roller 5 is rotated by the rotation of the drum 4. The units LB scans the surface of each drum 4 with the laser beam Z modulated in accordance with an image signal. By this, electrostatic latent images corresponding to the respective image signals of the colors are formed on the surface of the drums 4. The formed latent image is developed into a toner image (developer image) by a developing roller 6 rotated at the predetermined speed in the direction of an arrow B in FIG. 3.

Through the above-described electrophotographic image forming process operations, a Y chromatic toner image is formed corresponding to the Y color component of the full-color image on the drum 4 of the first cartridge PY. The toner image is primary-transferred onto the belt 12 in the primary transfer portion T1 of the cartridge PY.

On the drum 4 of the second cartridge PM, an M chromatic toner image corresponding to the M color component of the full-color image is formed. The toner image is primary-transferred superposingly to the Y color toner image already transferred on the belt 12 in the primary transfer portion T1 of the cartridge PM.

On the drum 4 of the third process cartridge PC, a C chromatic toner image corresponding to the C color component of the full-color image is formed. The toner image is primary-transferred superposingly on the Y+M toner image already transferred on the belt 12 in the primary transfer portion T1 of the cartridge PC.

On the drum 4 of fourth cartridge PK, a K chromatic toner image corresponding to the K color component of the full-color image is formed. The toner image is primary-transferred superposingly on the Y+M+C toner image already transferred on the belt 12 in the primary transfer portion T1 of the cartridge PK.

In this manner, a four full-color toner image (unfixed) is formed on the belt 12. In each cartridge P, untransferred toner remaining on the surface of the drum 4 after the primary-transfer of the toner image to the belt 12 is removed by a cleaning blade 7 and is accommodated in a residual toner accommodating portion 27 of a cleaner container 26.

On the other hand, the sheet feeding roller 20 is actuated at predetermined control timing to single out the recording material S from the sheet feeding tray 19, and the recording material S is fed on the feeding path to the secondary transfer portion T2 by the registration roller unit 20*a* at predetermined control timing. By this, while the recording material S is fed through the secondary transfer portion T2, of four color superimposed toner image is secondary-transferred onto the surface of the recording material S all together.

The recording material S is separated from the surface of the belt 12 and is fed into the fixing unit 21 on the feeding path 23, and is heated and pressed by a fixing nip in the fixing unit 21. By this, the toner images of the respective colors are mixed and fixed on the recording material S. The recording material S is discharged from the fixing unit 21 and then is discharged onto the discharging tray 25 through the discharging unit 22 and the discharge opening 24.

[Structure of the Cartridge]

Figure 4:
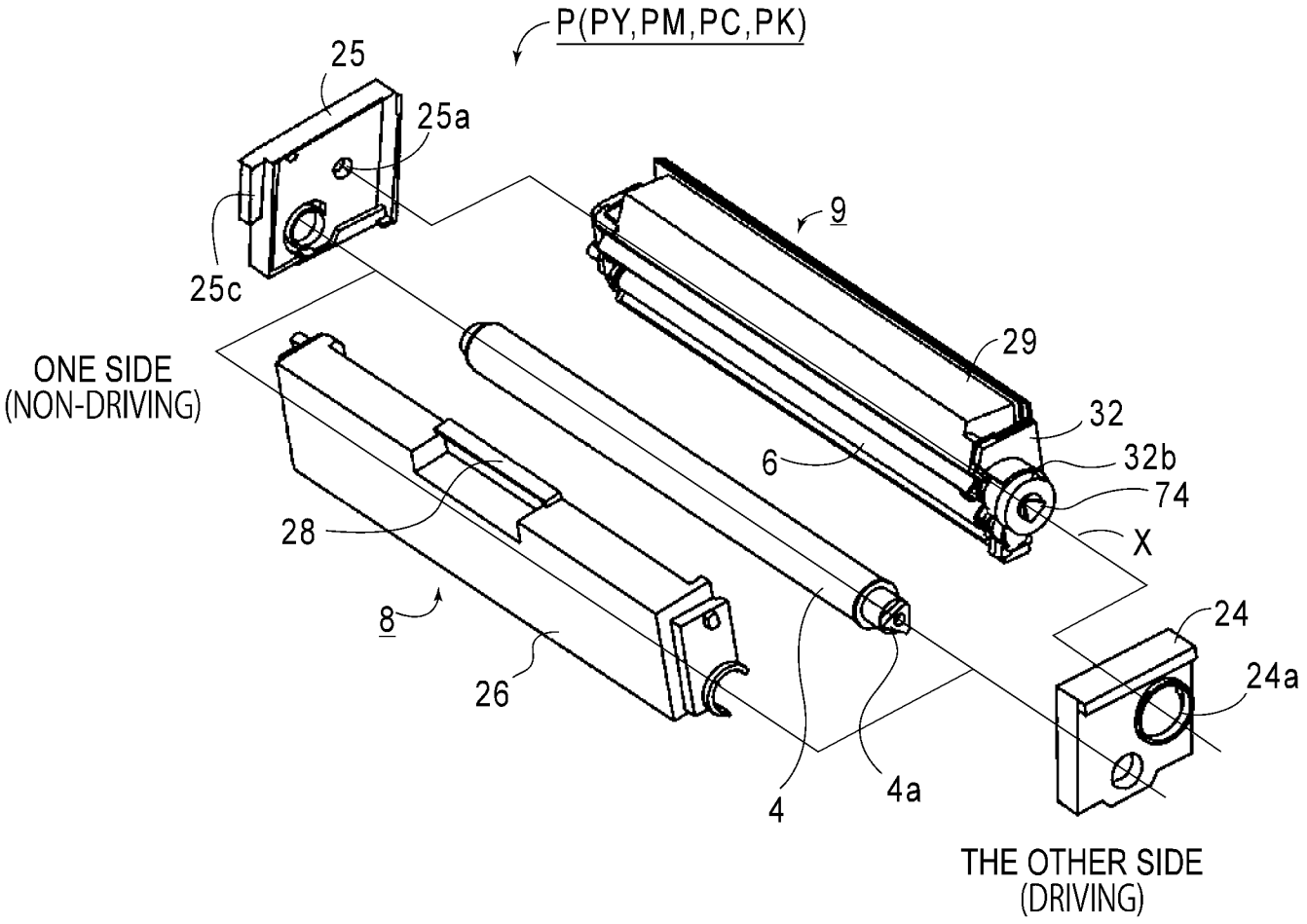
FIG. 4 is an exploded perspective view of the process cartridge according to the first embodiment.
Figure 5:
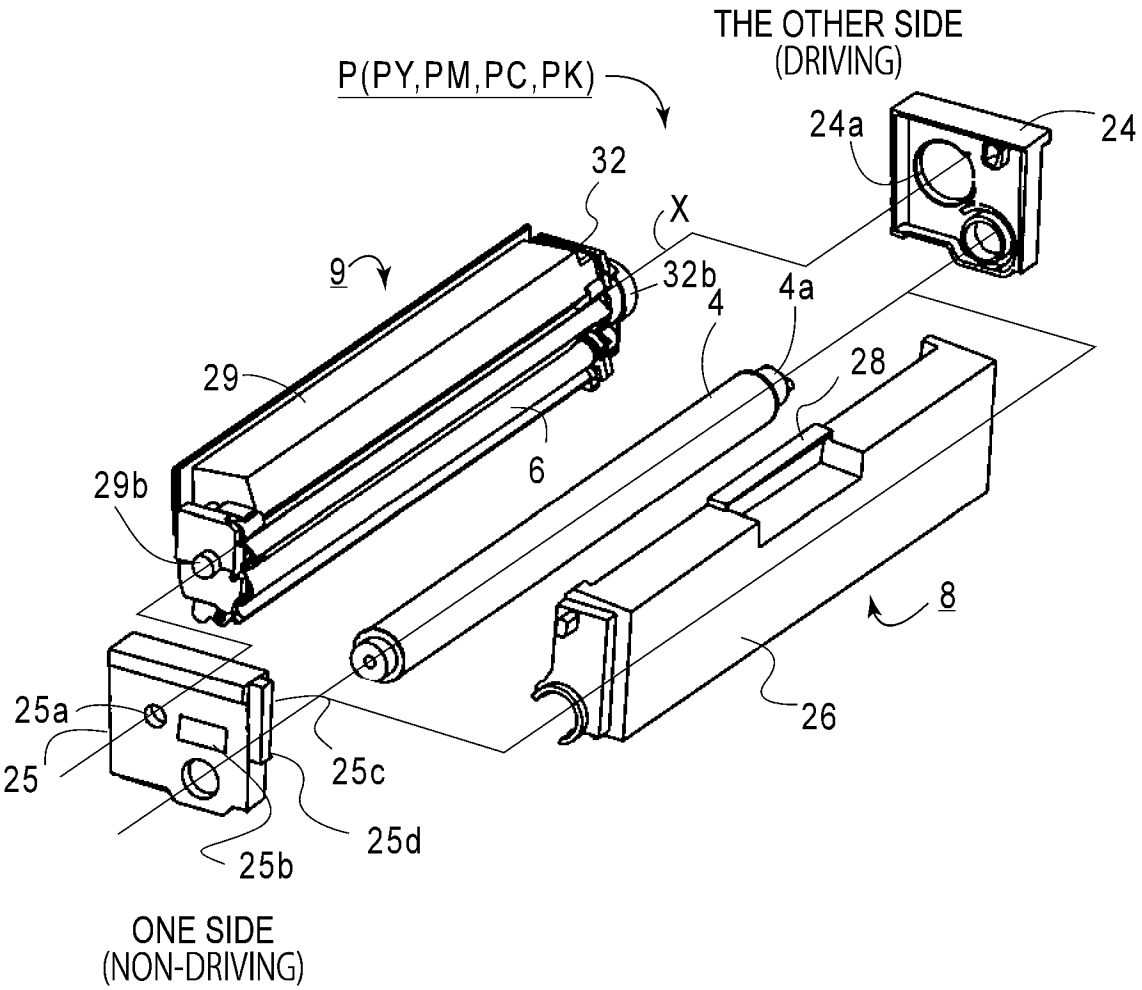
FIG. 5 is an exploded perspective view of the process cartridge according to the first embodiment.

FIG. 4 is an exploded perspective view of the cartridge P of this embodiment as seen from the driving side (other end portion side of the 4 with respect to the axial direction (longitudinal direction) of the drum 4, and FIG. 5 is an exploded perspective view as seen from one end portion side (non-driving side). Reference FIGS. 3-5, each cartridge P comprises a drum unit 8 including the drum 4, the charging roller 5 and the cleaning blade 7. In addition, it includes a developing unit 9 provided with the developing roller 6. The drum unit 8 and the developing unit 9 are connected to constitute the cartridge P.

[Structure of Drum Unit 8]

More specifically, the drum unit 8 includes the drum 4, the charging roller 5, the cleaning blade 7, the cleaner container 26, the residual toner accommodating portion 27 and cartridge cover members 24 and 25. The drum 4 is rotatably supported by a non-driving side cartridge cover member 25 and a driving side cartridge cover member 24 provided at opposite longitudinal end portions of the cartridge P. The non-driving side cartridge cover member 25 and the driving side cartridge cover member 24 are fixed to the cleaner container 26 at opposite longitudinal ends of the cleaner container 26, respectively.

As shown in FIG. 4, on the other end portion side of the drum 4, a coupling member 4*a* configured to transmit a driving force to the drum 4 is provided. The coupling member 4*a* engages with a coupling (unshown), as a drum drive outputting portion, of the main assembly 2 of the apparatus so that the driving force is transmitted from the driving motor (unshown) of the main assembly 2 of the apparatus to the drum 4.

The charging roller 5 is contacted to the drum 4 and is supported by the cleaner container 26 so as to be rotated by the rotation of the drum 4. The cleaning blade 7 is supported by the cleaner container 26 so as to contact the peripheral surface of the drum 4 at a predetermined pressure. The untransferred toner removed from the peripheral surface of the drum 4 by the cleaning blade 7 is accommodated in the residual toner accommodating portion 27 of the cleaner container 26.

The non-driving side cartridge cover member 25 and the driving side cartridge cover member 24 are provided with co-axial supporting hole portions 25*a* for swingably (movably) supporting the developing unit 9. A central portion of the upper surface of the cleaner container 26 with respect to the longitudinal direction is provided with a grip portion 28.

[Structure of Developing Unit 9]

As shown in FIG. 3, the developing unit 9 includes the developing roller 6, a developing blade 31 and a developing device frame 29 and so on. The developing device frame 29 includes the toner accommodating portion 49 for accommodating the toner to be supplied to the developing roller 6, and the developing blade 31 for regulating a layer thickness of the toner on the peripheral surface of the developing roller 6.

The developing blade 31 is a thin metal plate (sheet-like) having a thickness of approx. 0.1 mm and is mounted on a base plate 31*b* of metal material having a L-like section, by welding or the like. The developing blade 31 is mounted to the developing device frame 29 by fixing screws 31*c* at one and the other longitudinal end portions. The developing roller 6 includes a core metal 6*a* of metal material and a rubber portion 6*b*. The developing roller 6 is rotatably supported by bearing side plates (unshown) mounted to the opposite longitudinal ends of the developing device frame 29.

As shown in FIG. 4, one longitudinal end portion of developing unit 9 is provided with a development input coupling 74 for transmitting the driving force to the developing unit 9. The development input coupling 74 is engaged with the coupling (unshown) of the main assembly 2 of the apparatus as a development drive outputting portion to transmit the driving force from the driving motor (unshown) of main assembly 2 of the apparatus to the developing unit 9. The driving force inputted to the developing unit 9 rotates the developing roller 6 in the direction of an arrow B of FIG. 3 through a driving train (unshown) provided in developing unit 9.

[Assembling of Drum Unit 8 and Developing Unit 9]

Referring to FIG. 4 and FIG. 5, the mounting of the developing unit 9 and the drum unit 8 will be described. A projected portion 29*b* projected from the developing device frame 29 is engaged into the supporting hole portion 25*a* of the non-driving side cartridge cover member 25. An outside circumference of a cylindrical portion 32*b* of the developing device covering member 32 is engaged into a supporting hole portion 24*a* of the driving side cartridge cover member 24. By this, the developing unit 9 is rotatably supported by the drum unit 8, and during the image forming operation, the developing roller 6 can be positioned so as to act on the drum 4.

Here, a swing shaft X and swing center X is a rotation axis of the developing unit 9 and is an axis connecting the supporting hole portion 25*a* of the non-driving side cartridge cover member 25 and the supporting hole portion 24*a* of the driving side cartridge cover member 24. The cylindrical portion 32*b* of the developing device covering member 32 of the other end portion side is co-axial with the development input coupling 74. In other words, the developing unit 9 receives the driving force from the main assembly 2 of the apparatus at the swing center X thereof.

[Cartridge Exchanging System]

The toners accommodated in the toner accommodating portions 49 of the first-fourth cartridges PY, PM, PC, PK are consumed with use for image formation. The commercial value functioning cartridge is lost when the toner is consumed to such an extent that the quality of the formed image is not satisfactory to the user who bought the cartridge.

Under the circumstances, means (unshown) for detecting the remaining toner amount of each cartridge is provided, for example, and the detected remaining amount is compared with a preset threshold for cartridge lifetime forenotice and/or lifetime warning by the controller 70. For the cartridge with which the detected remaining amount is smaller than the threshold, the lifetime forenotice or the lifetime warning is displayed on a display portion (unshown) for the cartridge. By this, the user is promoted for preparation of the exchange cartridge, or is promoted to exchange the cartridge, thus maintaining the quality of the output image.

In the image forming apparatus 1 of this embodiment, a drawing type cartridge tray (supporting member) 10 for carrying the cartridges P, and the cartridge tray can be drawn out of the main assembly of the apparatus 2 from the front side of the main assembly (front access), thus improving the usability.

Figure 6:
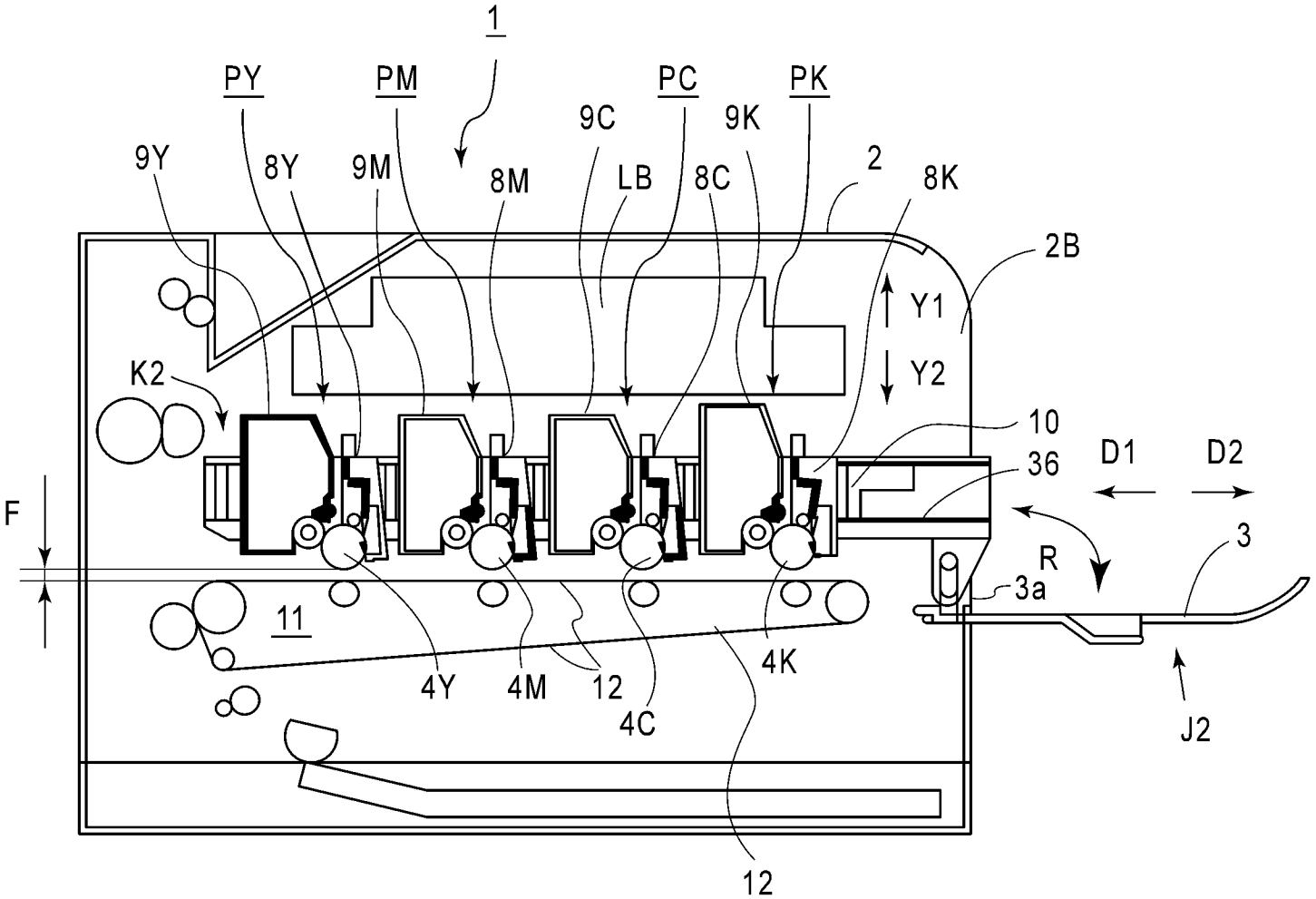
FIG. 6 is a schematic section of the image forming apparatus according to the first embodiment of the present invention.

More particularly, the front side of the main assembly 2 of the apparatus is provided with an opening 2B for permitting insertion of the cartridge P to a cartridge accommodating portion 2A inside the main assembly 2 of the apparatus and for permitting removal of the cartridge P. A front door (openable member) 3 is provided and is movable between a closing position (close position) J1 for closing the opening 2B as shown in FIG. 2 and an open position J2 for opening the opening 2B as shown in FIG. 6. That is, the front door 3 is capable of taking the closing position J1 and the open position J2.

In this embodiment, the front door 3 is rotatable relative to the main assembly 2 of the apparatus about a hinge portion 3*a* provided in the lower side of the door. More particularly, the front door 3 rotates about the hinge portion 3*a* to erect, thus taking the closing position as shown in FIG. 2. In this state, the opening 2B is closed. In addition, the front door 3 is rotated about the hinge portion 3*a* toward the front side to a substantially horizontal position as shown in FIG. 6. In this state, the opening 2B is wide-open. Designated by R is opening and closing directions of the front door 3 about the hinge portion 3*a*.

The supporting member (tray) 10 is in an inside position in which it is inside the main assembly 2 of the apparatus when the front door 3 is in the close position J1 as shown in FIG. 2 and in which the cartridges P are in image forming positions K1 where the image forming operation can be carried out. In this state, the cartridges P are press-contacted to positioning portions (unshown) of the main assembly 2 of the apparatus by urging forces of urging means (unshown) of the main assembly 2 of the apparatus. That is, all the cartridges P are held in the positioned state at the predetermined mounting position relative to the main assembly 2 of the apparatus. The drum 4 of each cartridge P contacts the belt 12.

In addition, the coupling member 4*a* and the development input coupling 74 of the cartridges P are engaged with the associated couplings (unshown) as the drum drive outputting portions and the couplings (unshown) as the development drive outputting portions, respectively. The electrical contact portions (unshown) of the cartridges P are electrically connected with the associated electrical contact portions (unshown) for bias voltage outputs (charging bias voltage and developing bias voltage) of the main assembly 2 of the apparatus.

When the front door 3 is opened from the close position J1 of FIG. 2 to the open position J2 of FIG. 6, an interrelating mechanism (unshown) interrelating with the opening motion of the front door 3. By this operation, the coupling engagements between the coupling members 4*a* of the cartridges P and the development input couplings 74 of the main assembly 2 of the apparatus are released. The urging of the cartridges P by the urging means are also released. Then, the tray 10 is moved from the image forming position K1 in the direction of an arrow Y1 through a predetermined amount and positioned in a movable position K2 shown in FIG. 6 inside the main assembly 2 of the apparatus.

By the upward movement of the tray 10 from the image forming position K1 to the movable position K2, the cartridges P are raised from the mounting position so that the drums 4 are kept away from the belt 12 by a predetermined distance F. In addition, by the movement of the cartridges P, the connection between the electrical contact portions of the cartridges P and the electrical contact portions of the main assembly 2 of the apparatus are also broken.

Figure 7:
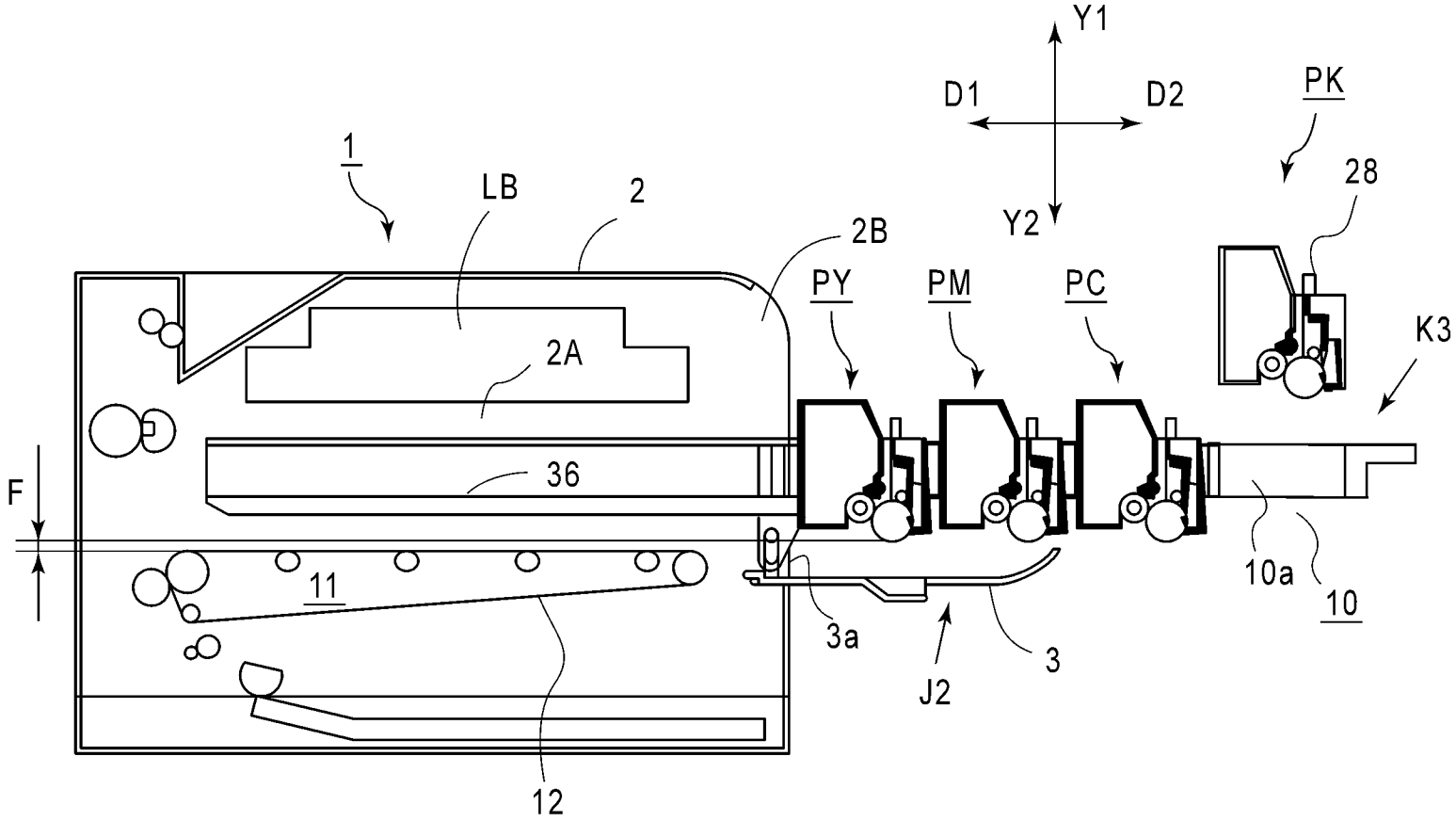
FIG. 7 is a schematic section of the image forming apparatus according to the first embodiment of the present invention.

The tray 10 can be drawn out from the movable position K2 in the direction of an arrow D2 to a predetermined outside position K3 (outside of the main assembly of the apparatus 2) shown in FIG. 7, through the opening 2B. The tray 10 is movable in the direction perpendicular to (crossing with) the longitudinal direction of the cartridge P while supporting four cartridges P. The four cartridges P are arranged on the tray 10 in the direction of the moving direction between the movable position K2 and the outside position K3.

Thus, when the tray 10 moves, the drums 4 of the cartridges P are separated from the belt 12 by a distance F, and therefore, the tray 10 moves from the movable position K2 to the outside position K3 without the contact therebetween. When the tray 10 is drawn out to the predetermined outside position K3, any further drawing-out movement is prevented. In addition, the tray 10 is stably held in the drawn-out position. In the outside position K3, the cartridges P can be exchanged relative to the tray 10.

The tray 10 in the outside position K3 can be moved into the main assembly 2 of the apparatus to the movable position K2 through the opening 2B in the direction of an arrow D1.

During this movement, the drums 4 of the cartridges P are separated from the belt 12 by a predetermined distance F, so that the tray 10 moves from the outside position K3 to the movable position K2 while the drums 4 are kept out of contact with the belt 12.

In the state that the tray 10 is in the movable position K2, the front door 3 can be closed. By the operation of the interrelating mechanism (unshown) interrelated with the closing operation of the front door 3, the tray 10 moves downwardly through a predetermined amount from the movable position K2 in the image forming position K1. By this, the cartridges P is positioned in the mounting position in which the drums 4 of the cartridges P are contacted with the belt 12.

By the operation interrelated with the continuing closing operation of the front door 3, the coupling as the drum drive outputting portion and the coupling as the development drive outputting portion of the main assembly 2 of the apparatus are engaged with the coupling member 4*a* and the development input coupling 74 of each cartridge P, respectively. Subsequently, the urging means operates to press-contact the cartridges P to the positioning portion of the main assembly 2 of the apparatus to place them in the predetermined mounting position. In addition, the electrical contact portions of the cartridges P are electrically connected with the bias voltage output electrical contact portions of the main assembly 2 of the apparatus. In this manner, the cartridges P restore to the state capable of image formation.

The tray 10 will be described further. As shown in part (b) of FIG. 1 and part (b) of FIG. 9, a non-driving side main assembly frame 33 and a driving side main assembly frame 35 at one longitudinal end portion (left side) and the opposite end (right side) are provided with a non-driving side guiding member 34 and a driving side guiding member 36. The guiding members 34 and 36 are horizontal members extending in the front and rear direction, and the other longitudinal end portion and the one longitudinal end portion of the tray 10 are carried on a guiding members 34 and 36. By this, the tray 10 is supported by the guiding members 34, 36.

The guiding member 34 and 36 are moved up and down in parallel with each other by the interrelating mechanism operated in accordance with the opening and closing operations of the front door 3. More particularly, the guiding members 34 and 36 moves up from the predetermined low position to the predetermined high position, with the opening operation of the front door 3 from the close position J1 to the open position J2.

By this, the tray 10 is moved from the image forming position K1 (FIG. 2) to the movable position K2 (FIG. 6). The tray 10 in the movable position K2 can be drawn out along the guiding members 34 and 36 to the predetermined outside position K3 (FIG. 7). On the contrary, it can be moved back to the movable position K2 from the outside position K3.

In the state that the tray 10 is in the predetermined movable position K2, the front door 3 can be closed from the open position J2 (FIG. 6) to the close position J1 (FIG. 2). In accordance with the closing operation of the front door 3, the guiding members 34 and 36 are moved down from the predetermined high position to the predetermined low position. By this, the tray 10 is movement from the movable position K2 to the image forming position K1.

As described above, in the state that the front door 3 is open, the tray 10 is movable relative to the main assembly 2 of the apparatus in the direction of the arrow D1 (push-in) and in the direction of the arrow D2 (draw-out) direction. That is, the tray 10 is provided so as to be drawn out of and pushed into the main assembly 2 of the apparatus through the opening 2B. In addition, in this embodiment, the tray 10 is provided so as to be movable substantially in the horizontal direction in the state that the main assembly 2 of the apparatus is installed on a horizontal surface (floor). Furthermore, the tray 10 is movable between the inside position in which it is inside the main assembly 2 of the apparatus and the outside position K in which it is outside the main assembly 2 of the apparatus.

The inside position of the tray 10 will be described further. Inside the main assembly of the apparatus 2, the tray 10 is movable between the image forming position K1 in which the cartridge P is capable of forming images and position K2 in which the cartridge P is spaced from the belt 12. In the position K2, the tray 10 can be moved to the outside position K3 (movable position). In this embodiment, the inside position includes the image forming position K1, the movable position K2 and the position therebetween. The tray 10 is provided with a mounting portion 10*a* (FIGS. 7, 8) to which a plurality of cartridges P are mountable. The tray 10 of this embodiment includes a rectangular large frame portion which is partitioned by 3 partition plates substantially equally in the front and rear direction into four elongated small frame portions. The small frame portions are the mounting portion 10*a* to which first-fourth cartridges PY, PM, PC, PK are detachably mountable.

In this embodiment, the tray 10 supports the cartridges PY, PM, PC, PK in the order named in the direction from the upstream side to the downstream side with respect to the direction of the movement from the movable position K2 to the outside position K3. When the tray 10 is in the outside position K3, the process cartridges P can be mounted to the mounting portion 10*a*.

The tray 10 in the outside position K3 holds the cartridges P so that the cartridges P are removable individually in the upward direction Y1. By the cartridges P being moved in the downward direction Y2, they are supported by the tray 10. The used cartridge to be replaced is lifted up (Y1) from the tray 10 to remove the used cartridge. Then, a new cartridge is inserted into the tray 10 from above.

Thus, when the tray 10 is outside the main assembly 2 of the apparatus, the cartridge P can be mounted to and dismounted from the main assembly 2 of the apparatus. When the user mounts and demounts the cartridge P relative to the tray 10, the user grips the grip portion 28 of the cartridge P.

In this embodiment, the cartridge PK, among the cartridges P containing different color developers, that contains K color toner, is supported at the downstream most position with respect to the moving direction of the tray 10 from the movable position J to the outside position K3.

The toner consumption rate of the cartridge PK is larger than that of the other cartridge, that is, the exchange frequency is high. Such a cartridge PK is supported by the tray 10 at front side of the main assembly of the apparatus 2. Therefore, when the cartridge PK can be exchanged, it will suffice if the tray 10 is drawn out through a small amount by which the cartridge PK is exposed outside. It is not necessary to draw out the tray 10 to the limited by the stopper, when the cartridge PK is to be replaced. Therefore, the exchanging operation property of the cartridge PK is improved.

In other words, when the cartridge PK is mounted and demounted relative to the tray 10, the tray 10 may not be drawn out to the limit. In the process of the tray 10 moving from the movable position K2 to the outside position K3, the cartridges sequentially become removable in the order from the downstream one, and at the outside position K3 all of the cartridges are removable.

The tray 10 is movable in the direction perpendicular to (crossing with) the axial direction of the drum 1 (longitudinal direction of the cartridge P) of the cartridge P carried on the tray 10. The moving direction of the tray 10 between the movable position K2 and the outside position K3 is the direction perpendicular to the longitudinal direction of the cartridge P. The cartridges P are arranged in the moving direction between the movable position K2 and the outside position K3.

The tray 10 for carrying the cartridge P can take the image forming position K1 and the movable position K2 which are the inside positions, and also the outside position K3.

As described in the foregoing, it is possible to move the plurality of cartridges P all together into and out of the main assembly 2 of the apparatus by the tray 10.

[Structures of Tray 10 and Cartridge P]

Figure 8:
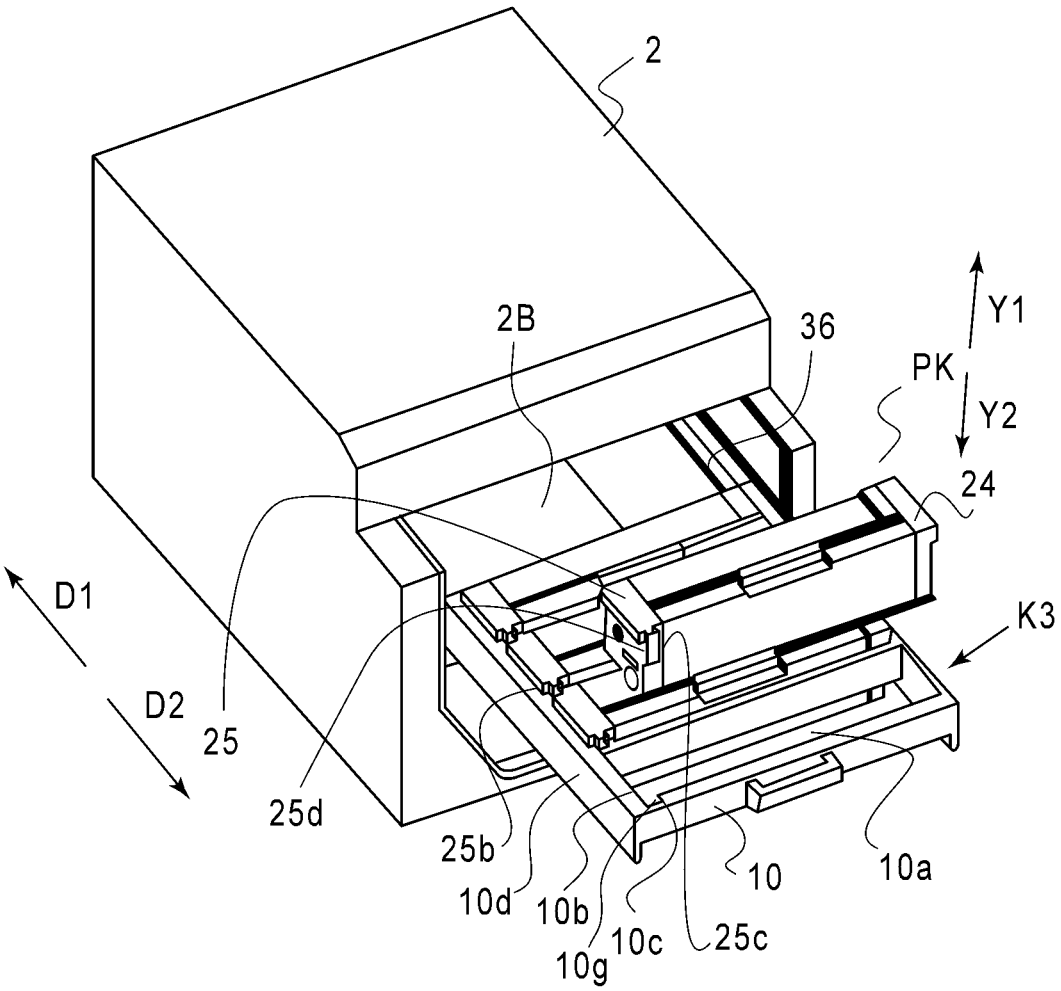
FIG. 8 is a perspective view of the image forming apparatus according to the first embodiment.
Figure 9:
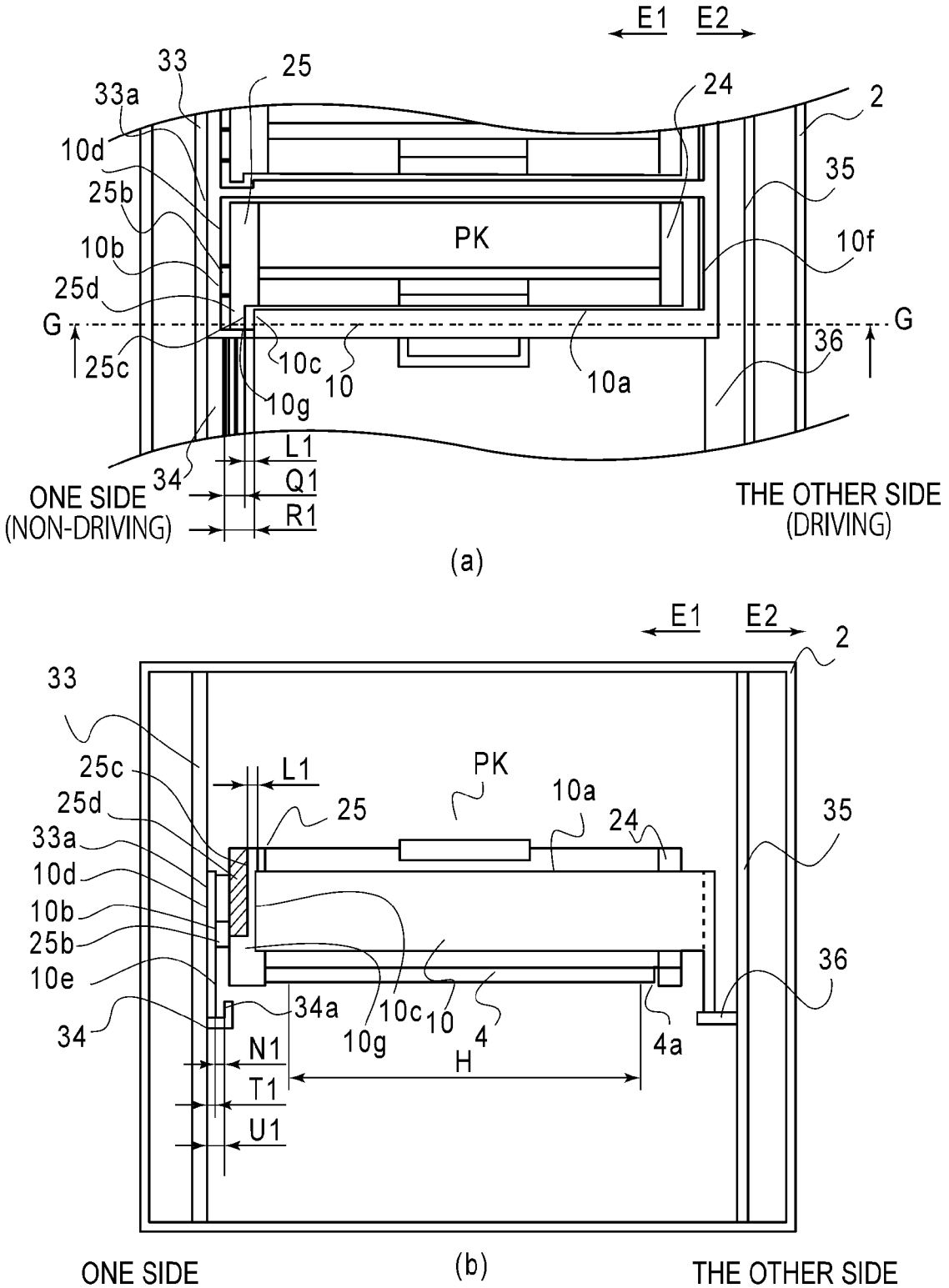
FIG. 9 is a schematic section of the image forming apparatus according to the first embodiment of the present invention.

Referring to FIGS. 7, 8 and 9, the mounting of the cartridge P to the main assembly 2 of the apparatus will be described in detail. FIG. 8 is a perspective view illustrating the state before the cartridge PK is mounted after the tray 10 is drawn out to the outside position K3. FIG. 9 illustrates the state in which the cartridge P and the tray 10 are adjacent one longitudinal end portion (non-driving side) in the main assembly 2 of the apparatus. Part (a) of FIG. 9 is a view of the tray 10 carrying the cartridge PK as seen in the inserting direction (arrow Y2 in FIG. 7) of the cartridge PK, and (b) is a sectional view taken along the direction of an arrow G in (a).

Here, the one longitudinal end portion of the image forming apparatus 1 is an outside portion of an image range H on the drum 4 shown in part (a) of FIG. 9 with respect to the longitudinal direction, in the direction E1 (leftward direction, in part (a) of FIG. 9). In addition, the other end portion side of the image forming apparatus 1 is an outside portion of the image range with respect to the longitudinal direction, in the direction of E2 (rightward direction) in part (a) of FIG. 9.

As shown in FIGS. 7 and 8, the cartridge PK is mounted to the mounting portion 10*a* of the tray 10 drawn out to the outside position K3, in the direction (arrow Y1 or Y2) perpendicular to the moving direction (arrow D1 or D2) of the tray 10.

As shown in FIGS. 5 and 8 and part (a) of FIG. 9, the non-driving side cartridge cover member 25 of the cartridge PK is provided with a first portion-to-be-regulated 25*b* facing toward the one longitudinal end portion. In addition, a projection 25*d* projecting from the non-driving side cartridge cover member 25 in the direction (arrow D2 in FIG. 7) perpendicular to the longitudinal direction is provided with a second portion-to-be-regulated 25*c* facing toward the other longitudinal end portion.

In the one longitudinal end portion of the tray 10, an inner surface of the mounting portion 10*a* is provided with a first regulating portion 10*b* facing toward the other longitudinal end portion. In the one longitudinal end portion of the tray 10, a recess 10*g* recessing in the direction (arrow D2 in FIG. 7) perpendicular to the longitudinal direction is provided with a second regulating portion 10*c* facing toward the one longitudinal end portion.

Thus, the first portion-to-be-regulated 25*b*, the second portion-to-be-regulated 25*c*, the first regulating portion 10*b*, the second surface-to-be-positioned 10*c* are all provided in the one longitudinal end portion of the image forming apparatus 1.

When the cartridge PK is mounted to the mounting portion 10*a* of the tray 10, the first cartridge 25*b* faces the first regulating portion 10*b*. In addition, the second cartridge positioning surface 25*c* faces the second regulating portion 10*c*.

As shown in part (b) of FIG. 9, the one longitudinal end portion of the tray 10 is provided with a third portion-to-be-regulated 10*d* facing toward the one longitudinal end portion. Similarly, the one longitudinal end portion of tray 10 is provided with a fourth portion-to-be-regulated 10*e* facing toward the other longitudinal end portion.

The non-driving side main assembly frame 33 at the one longitudinal end portion of the main assembly 2 of the apparatus is provided with a third regulating portion 33*a* facing the other longitudinal end portion. The non-driving side guiding member 34 provided on the non-driving side main assembly frame 33 is provided with a fourth regulating portion 34*a* facing the one longitudinal end portion.

Thus, all of the third portion-to-be-regulated 10*d*, the fourth portion-to-be-regulated 10*e*, the third regulating portion 33*a* and the fourth regulating portion 34*a* are disposed at the one longitudinal end portion of the image forming apparatus 1. The tray 10 is movably supported by the non-driving side guiding member 34 provided on the non-driving side main assembly frame 33 and the driving side guiding member 36 provided on the driving side main assembly frame 35 in the main assembly 2 of the apparatus. When the tray 10 is in the image forming position K1, the third portion-to-be-regulated 10*d* is faced to the third regulating portion 33*a*. In addition, the fourth portion-to-be-regulated 10*e* is faced to the fourth regulating portion 34*a*.

That is, the cartridge P includes the first portion-to-be-regulated 25*b* which is contacted to the first regulating portion 10*b* provided on the tray 10 to be prevented from moving in one of longitudinal directions. In addition, the cartridge P includes the second portion-to-be-regulated 25*c* which is contacted to the second regulating portion 10*d* provided on the tray 10 to be prevented from moving in the other one of longitudinal directions.

The tray 10 includes the third portion-to-be-regulated 10*d* which is contacted to the third regulating portion 33*a* provided in the main assembly 2 of the apparatus to be prevented from moving in one of the longitudinal directions. In addition, the tray 10 includes the fourth portion-to-be-regulated 10*e* which is contacted to the fourth regulating portion 34*a* provided in the main assembly 2 of the apparatus to be prevented from moving in the other one of the longitudinal directions.

All of the portions-to-be-regulated and the regulating portions 25*b*, 10*b*, 25*c*, 10*c*, 10*d*, 33*a*, 10*e* are provided longitudinally outside the image forming region H but inside the main assembly 2 of the apparatus.

In the main assembly 2 of the apparatus, the drum 4 and the process means actable on the drum 4 has to be provided in the image range shown in part (b) of FIG. 9 with respect to the longitudinal direction, in order to form images. For this reason, the portion-to-be-regulated and the regulating portions 25*b*, 10*b*, 25*c*, 10*c*, 10*d*, 33*a*, 10*e*, 34*a* are disposed outside the image range H with respect to the longitudinal direction. By doing so, the image forming apparatus 1 can be downsized without influence to the image formation.

Figure 1:
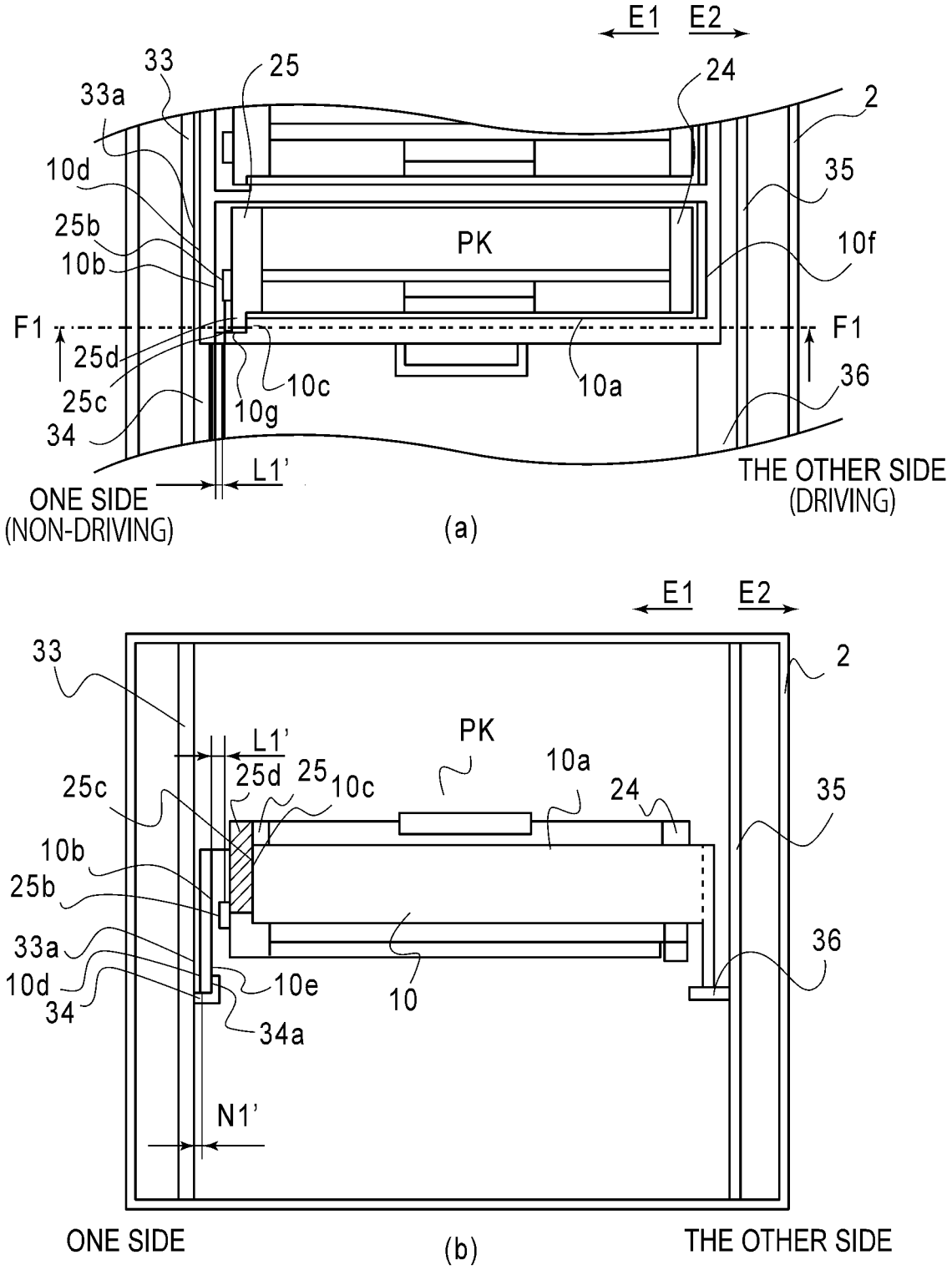
FIG. 1 is a schematic section of an image forming apparatus according to a first embodiment of the present invention.

Referring to FIGS. 1 and 9, a positioning method for the cartridge PK and the tray 10 in the main assembly 2 of the apparatus will be described. FIG. 1 illustrates a state in which the cartridge P and the tray 10 are shifted to the other end portion side in the main assembly 2 of the apparatus. Part (a) of FIG. 1 is a view of the tray 10 carrying the cartridge PK, as seen in the inserting direction (arrow Y2 in FIG. 7) of the cartridge PK, and (b) is a sectional view in the direction of an arrow F1.

As shown in parts (a) and (b) of FIG. 9, the tray 10 is supported on the non-driving side guiding member 34 provided on the non-driving side main assembly frame 33 and the driving side guiding member 36 provided on the driving side main assembly frame 35. The cartridge is supported by the tray 10.

In addition, the cartridge PK is moved in the direction of an arrow E1 in FIG. 9 by the coupling member 4*a* of the drum 4 urged by the by the drive outputting portion (unshown) of the main assembly 2 of the apparatus. At this time, the first portion-to-be-regulated 25*b* of the non-driving side cartridge cover 25 contacts the first regulating portion 10*b* of the tray 10 so that the position of the cartridge PK is regulated in the longitudinal direction.

Furthermore, the first regulating portion 10*b* receives an urging force at first portion-to-be-regulated 25*b* so that the tray 10 also moves in the direction of the arrow E1 in FIG. 9. At this time, the third portion-to-be-regulated 10*d* of the tray 10 contacts the third regulating portion 33*a* of the non-driving side main assembly frame 33 so that the position of the tray 10 is regulated in the longitudinal direction. That is, the position of the cartridge P relative to the main assembly 2 of the apparatus with respect to the longitudinal direction (arrow E1 in FIG. 9) is regulated by way of the tray 10.

As described in the foregoing, when the front door 3 is closed from the open position J2 (FIG. 6) to the close position J1 (FIG. 2), the tray 10 is first moved from the movable position K2 to the image forming position K1 in interrelation with the closing operation. Then, the drive outputting portion of the main assembly side of the apparatus engages with the drive inputting portion of the cartridge P. Thereafter, the cartridges P are urged to the positioning portion by the urging means. Therefore, the cartridge P and the tray 10 move in the direction of the arrow E1 at the stage in which the drive outputting portion of the main assembly side of the apparatus engages with the drive inputting portion of the cartridge P.

Here, the distance between the first portion-to-be-regulated 25*b* and the second portion-to-be-regulated 25*c* is width Q1, and the distance between the first regulating portion 10*b* and the second regulating portion 10*c* is width R1. In order to mount and demount the cartridge P on the tray 10 without stress taking tolerances into consideration, the width R1 has to be larger then the width Q1. Then, when the cartridge P is at the one end portion side with respect to the longitudinal direction (arrow E1 in FIG. 9), a gap L1 (R1−Q1=L1) which is a difference between the width R1 and the width Q1, between the second portion-to-be-regulated 25*c* and the second regulating portion 10*c*.

As shown in part (b) of FIG. 9, a distance between the third portion-to-be-regulated 10*d* and the fourth portion-to-be-regulated 10*e* is width T1, and a distance between the third regulating portion 33*a* and the fourth regulating portion 34*a* is width U1. In order to mount and demount the tray 10 to the main assembly of the apparatus 2 without stress taking tolerances into consideration, the width U1 has to be larger then the width T1. That is, when the tray 10 is moved to the one end portion side with respect to the longitudinal direction (arrow E1 in FIG. 9), a gap N1 (U1−T1=N1) which is a difference between the width U1 and the width T1 is produced between the fourth portion-to-be-regulated 10*e* and the fourth regulating portion 34*a*.

In the transportation of the image forming apparatus 1 loaded with the cartridge PK therein, an impact may be imparted to the image forming apparatus 1 because of the vibration or the like during the transportation, with the result of application of the force to the other end portion sides of the tray 10 and the cartridge PK (arrow E2 in part (a) of FIG. 1).

At this time, as shown in parts (a) and (b) of FIG. 1, the cartridge PK moves in the direction of the arrow E2 in FIG. 1 so that the second portion-to-be-regulated 25*c* of the non-driving side cartridge cover 25 contacts to the second regulating portion 10*c* of the tray 10. The movement of the cartridge P due to the transportation is against the positioning and fixing force of the urging means. Then, a gap L1' is produced between the first portion-to-be-regulated 25*b* with first regulating portion 10*b*, so that the cartridge P is regulated at the other end portion side with respect to the longitudinal direction (arrow E2 in part (a) of FIG. 1) in the state that it is away by L1'.

In addition, the tray 10 also moves in the direction of the arrow E2 in FIG. 1, and therefore, the fourth portion-to-be-regulated 10*e* of the tray 10 contacts to the fourth regulating portion 34*a*. That is, a gap N1' is produced between the third portion-to-be-regulated 10*d* and the third regulating portion 33*a*, so that the tray 10 is regulated at the other end portion side with respect to the longitudinal direction (arrow E2 in part (a) of FIG. 1) in the state that it is away by N1'.

The structures of the cartridge PY and the tray 10, the structures of the cartridge PM and the tray 10 and the structures of the cartridge PC and the tray 10 are similar to those of the cartridge PK and the tray 10.

Figure 13:
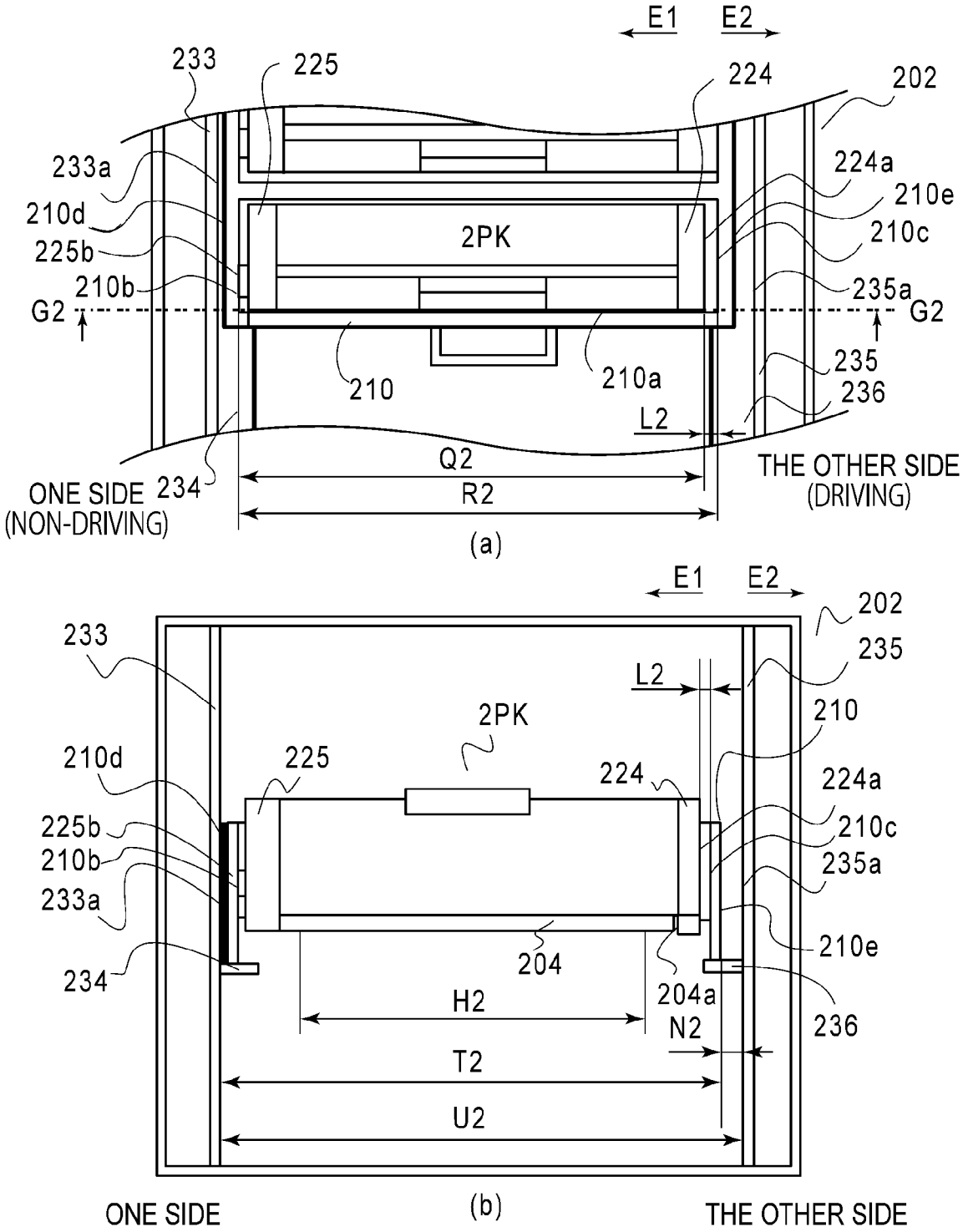
FIG. 13 is a schematic section of an image forming apparatus of a conventional structure.
Figure 14:
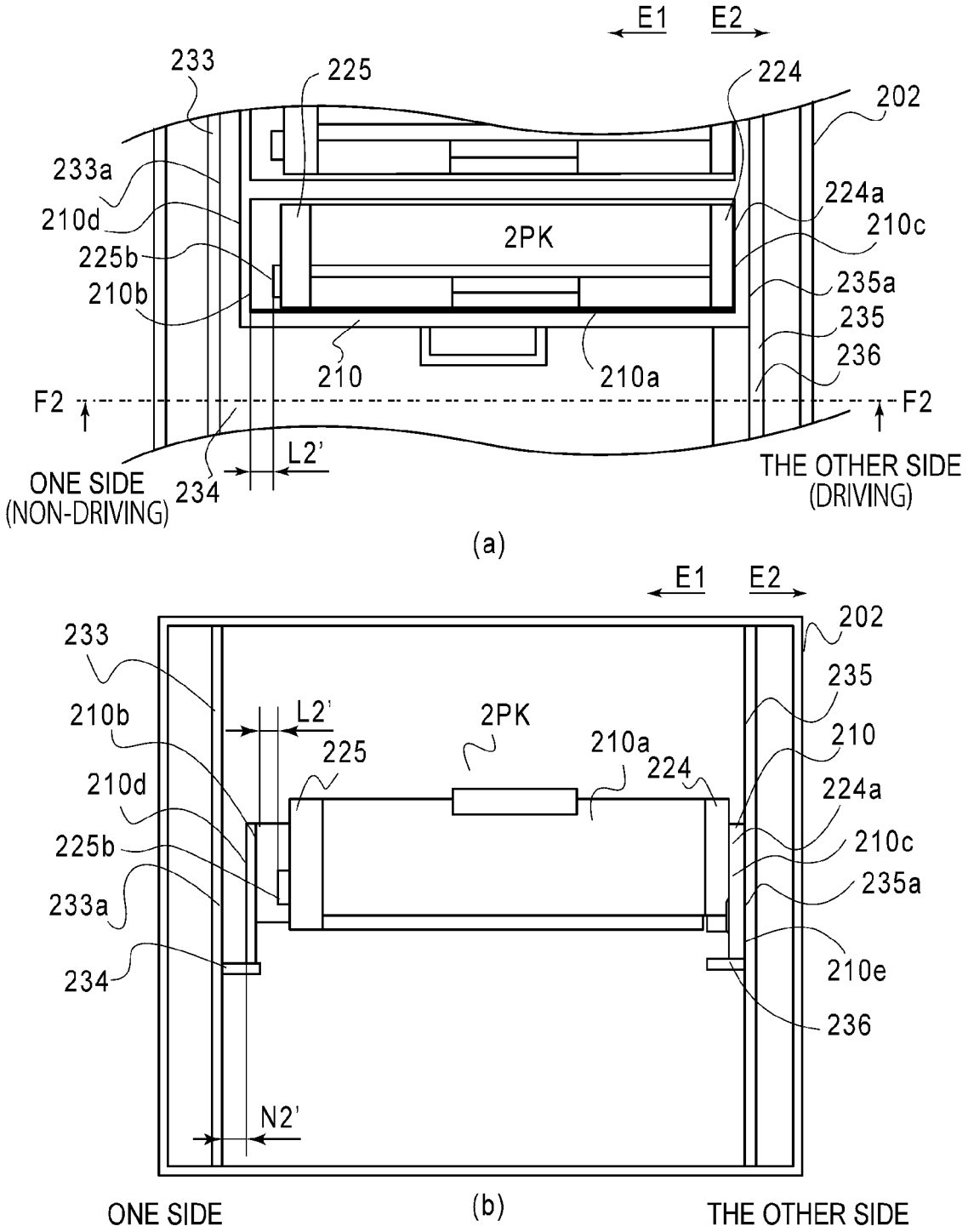
FIG. 14 is a schematic section of the image forming apparatus of the conventional structure.

Referring to FIGS. 13 and 14, a conventional structure will be described. FIG. 13 illustrates a state in which the cartridge 2PK and the tray 210 are shifted to the one longitudinal end portion. Part (a) of FIG. 13 are a view of the tray 210 carrying the cartridge 2PK as seen in the inserting direction of the cartridge 2PK, (b) is a sectional view in the direction of an arrow G2.

FIG. 14 illustrates a state in which the cartridge 2PK and the tray 210 are shifted to the other end portion side in the main assembly of the apparatus 202 in the conventional structure. Part (a) of FIG. 14 are a view of the tray 210 carrying the cartridge 2PK as seen in the inserting direction of the cartridge 2PK, (b) is a sectional view in the direction of an arrow F2.

With the conventional structure, as shown in parts (a) and (b) of FIG. 13, the non-driving side cartridge cover member 225 of the cartridge 2PK is provided with a first portion-to-be-regulated 225*b* in the direction facing toward one longitudinal end portion. A side surface of the driving side cartridge cover 224 is provided with a second portion-to-be-regulated 224*a* facing toward the other longitudinal end portion. An inner surface of the mounting portion 210*a* of the one longitudinal end portion of the tray 210 is provided with a first regulating portion 210*b* facing toward the other longitudinal end portion.

Similarly, an inner surface the other longitudinal end portion of the mounting portion 210*a* of the tray 210 is provided with a second regulating portion 210*c* facing toward the one longitudinal end portion. That is, the first portion-to-be-regulated 225*b* and the first regulating portion 210*b* are provided at one longitudinal end portion, and the second portion-to-be-regulated 225*c* and the second regulating portion 210*c* are provided at the other longitudinal end portion.

As shown in part (b) of FIG. 13, the one longitudinal end portion of the tray 210 is provided with a third portion-to-be-regulated 210*d*. The other longitudinal end portion of the tray 210 is provided with a fourth portion-to-be-regulated 210*e* facing toward the other longitudinal end portion.

The non-driving side main assembly frame 233 at the one longitudinal end portion in the main assembly 202 of the apparatus is provided with a third regulating portion 233*a* facing toward the other longitudinal end portion. The driving side main assembly frame 235 at the other longitudinal end portion is provided with a fourth regulating portion 235*a* facing toward the one longitudinal end portion.

That is, the third portion-to-be-regulated 210*d*, the third regulating portion 233*a* are provided at the one longitudinal end portion of the main assembly of the image forming apparatus 202, and the fourth portion-to-be-regulated 210*e* and the fourth regulating portion 234*a* are provided at the other longitudinal end portion.

The tray 210 is supported by a non-driving side guiding member 234 of the non-driving side main assembly frame 233 and a driving side guiding member 236 of the driving side main assembly frame 235, in the main assembly 202 of the apparatus. The cartridge 2PK is supported on the tray 210. In addition, the cartridge 2PK is moved in the direction of an arrow E1 in FIG. 13 by the coupling member 204*a* of the drum 4 urged by the by the drive outputting portion (unshown) of the main assembly 2 of the apparatus.

At this time, the first portion-to-be-regulated 225*b* of the non-driving side cartridge cover 225 contacts the first regulating portion 210*b* of the tray 210, so that the position of the process cartridge 2PK is regulated at the longitudinal direction.

Furthermore, the first regulating portion 210*b* receives an urging force at first portion-to-be-regulated 225*b* so that the tray 210 also moves in the direction of the arrow E1 in FIG. 13. At this time, the third portion-to-be-regulated 210*d* of the tray 210 contacts the third regulating portion 233*a* of the non-driving side main assembly frame 233 so that the position of the tray 210 is regulated in the longitudinal direction. That is, the position of the process cartridge P in the longitudinal direction (arrow E1 in FIG. 13) relative to the main assembly of the image forming apparatus 202 is regulated by way of the tray 210.

Here, a distance between the first portion-to-be-regulated 225*b* and the second portion-to-be-regulated 224*a* is width Q2, and a distance between the first regulating portion 210*b* and the second regulating portion 210*c* is width R2. In order to mount and demount the cartridge 2PK on the tray 210 without stress taking tolerances into consideration, the width R2 has to be larger then the width Q2. When the cartridge 2PK is shifted to the one end portion side with respect to the longitudinal direction, a gap L2 (R2−Q2=L2) which is a difference between the width R2 and the width Q2 is produced between the second portion-to-be-regulated 224*a* and the second regulating portion 210*c*.

A distance between the third portion-to-be-regulated 210*d* with fourth portion-to-be-regulated 210*e* is width T2, and a distance between the third regulating portion 33*a* of the non-driving side frame 33 and the fourth regulating portion 235*a* of the driving side main assembly frame 235 is width U2. In order to mount and demount the tray 210 to the main assembly of the apparatus 202 without stress taking tolerances into consideration, the width U2 has to be larger then the width T2. More particularly, when the tray 210 is shifted to the one end portion side in the longitudinal direction, a gap N2 (U2−T2=N2) which is a difference between the width U2 and the width T2 is produced between the fourth portion-to-be-regulated 210*e* and the fourth regulating portion 235*a*.

With the conventional structure, when an impact is imparted to the image forming apparatus 1 during transportation, the cartridge 2PK moves in the direction of the arrow E2, as shown in parts (a) and (b) of FIG. 14, so that the second portion-to-be-regulated 224*a* contacts to the second regulating portion 210*c*. That is, a gap L2' is produced between the first portion-to-be-regulated 225*b* and the first regulating portion 210*b*, so that the process cartridge 2PK is regulated at the other end portion side in the longitudinal direction in the state that it is away by L2'.

Furthermore, the tray 210 also moves in the direction of an arrow E2 in FIG. 14, so that the fourth portion-to-be-regulated 210*e* and the fourth regulating portion 235*a* are contacted to each other. That is, a gap N2 is produced between the third portion-to-be-regulated 210*d* and the third regulating portion 233*a*, so that the tray 10 is regulated at the other end portion side in the longitudinal direction in the state that it is away by N2'.

In the transportation of the image forming apparatus 1, impacts are imparted in the longitudinal directions because of the vibrations. Therefore, the cartridge P and the tray 10 move repeatedly in the longitudinal directions in the main assembly 202 of the apparatus.

As compared with the structure of this Embodiment 1, the width R2 and the width Q2 are larger than the width R1 and the width Q1, respectively, and therefore, manufacturing tolerances of the parts with respect to the width R and the width Q2 tend to be larger than those with respect to the width R1 and the width Q1. In other words, the gap L2 which is the difference between the width R2 and the width Q2 is larger than the difference between the width R1 and the width Q1 (R2−Q2=L2>R1−Q1=L1). In addition, the width U2 and the width T2 are larger than the width U1 and the width T1, and therefore, the manufacturing tolerances of parts with respect to the width U2 and a width T2 tend to be larger than those with respect to the width U1 and the width T1. In other words, the gap N2 which is the difference between the width U2 and the width T2 is larger than the difference N1 between the width U1 and the width T1 (U2−T2=N2>U1−T1=N1).

Therefore, according to the structure of this Embodiment 1, as compared with the conventional structure, the movement distance of the cartridge P in the tray 10 can be reduced from L2 of FIG. 14 to L1 of FIG. 1. In addition, the movement distance of the tray 10 in the main assembly 2 of the apparatus can be reduced from N2 of FIG. 14 to N1 of FIG. 1.

In the transportation of the image forming apparatus 1, the impact in mounted to the cartridge P and the tray 10 can be suppressed because the movement distances of the cartridge P and the tray 10 in the main assembly 2 of the apparatus in the longitudinal direction can be reduced. Therefore, the rigidity and therefore the cost can be reduced, which leads to the downsizing and cost reduction of the image forming apparatus 1 and the cartridge P.

In this Embodiment 1, all of the portions-to-be-regulated and the regulating portions 25*b*, 25*c*, 10*b*, 10*c*, 10*d*, 10*e*, 33*a* and 34*a* are provided at the one longitudinal end portion of the image forming apparatus 1. This is not restrictive to the present invention, but they may all be provided at the other end portion side of the image forming apparatus 1.

Embodiment 2

Figure 10:
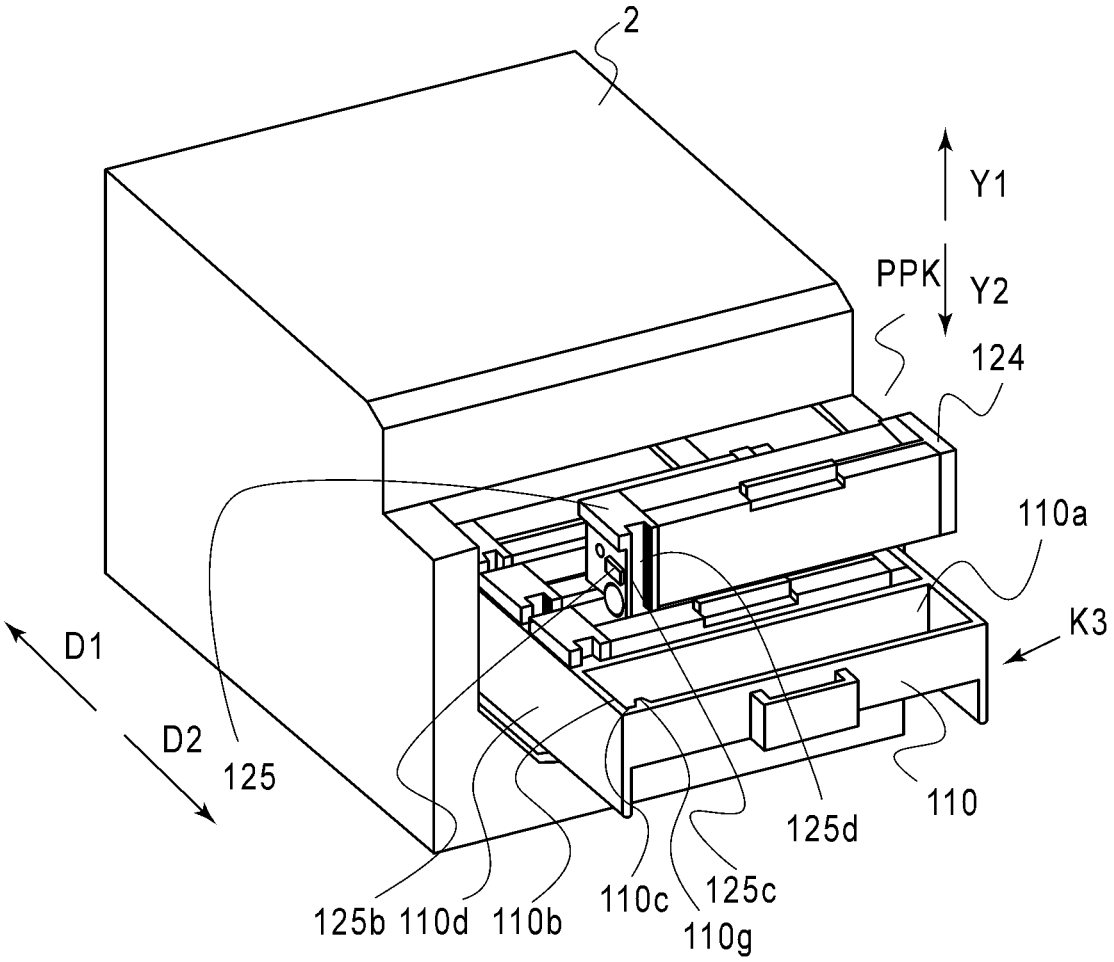
FIG. 10 is a perspective view of an image forming apparatus according to a second embodiment of the present invention.
Figure 11:
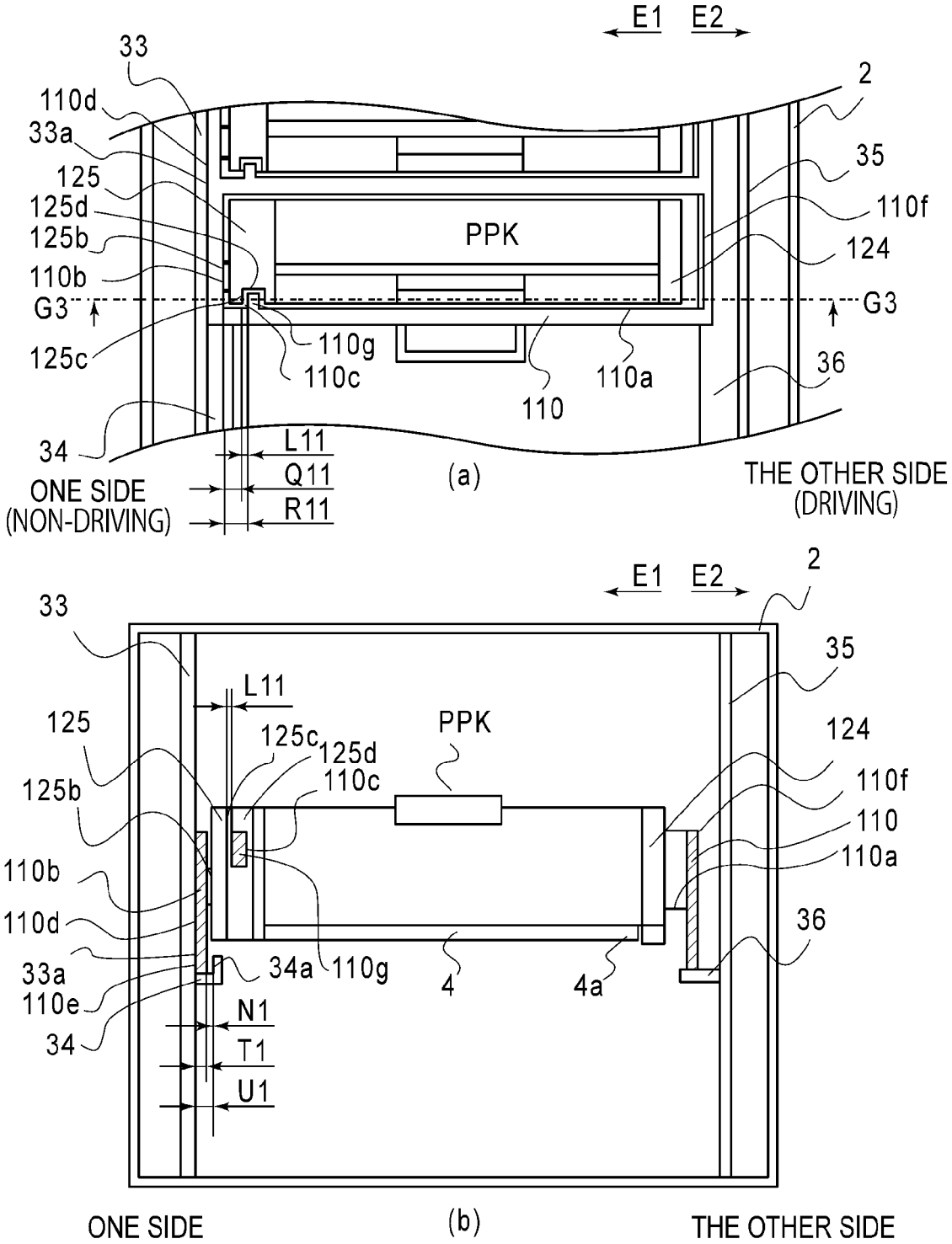
FIG. 11 is a schematic section of the image forming apparatus according to the second embodiment.
Figure 12:
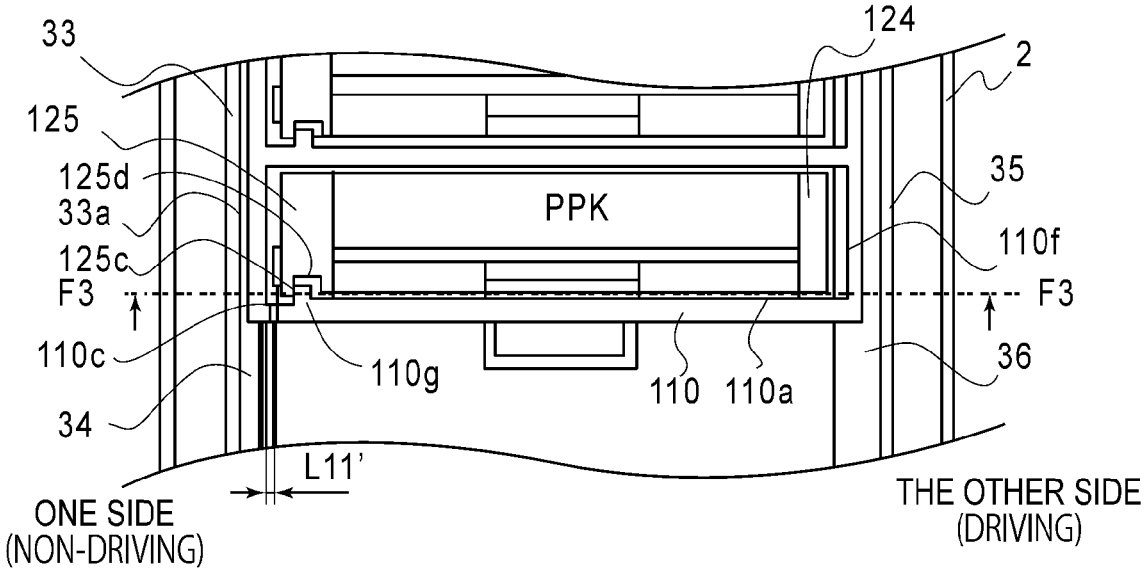
FIG. 12 is a schematic section of the image forming apparatus according to the second embodiment.
Figure 12:
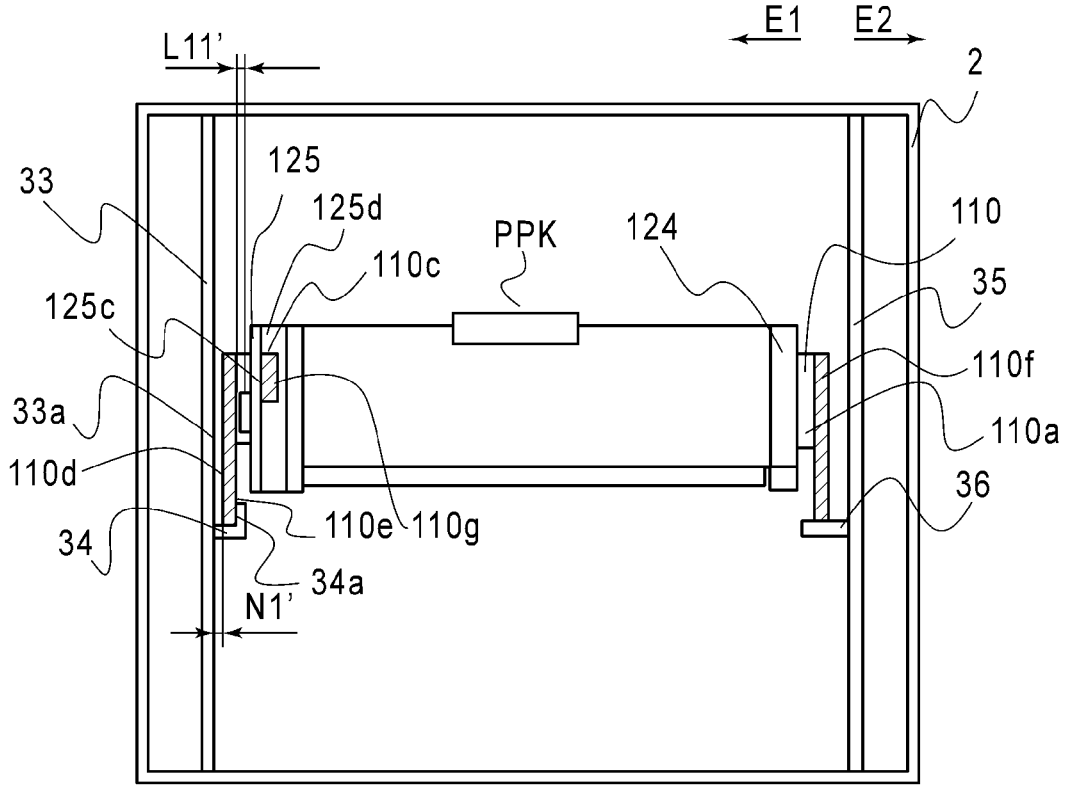

Referring to FIGS. 10, 11 and 12, a process cartridge and an image forming apparatus according to the second embodiment of the present invention will be described. The fundamental structures of this embodiment are similar to those of Embodiment 1, and therefore, in the description of this embodiment, the same reference numerals as in Embodiment 1 are assigned to the elements having the corresponding functions in this embodiment, and the detailed description thereof is omitted for simplicity.

[Structures of Tray 10 and Cartridge P].

Referring to FIGS. 10 and 11, the mounting of the cartridge PPK to the main assembly 2 of the apparatus will be described. FIG. 10 is a perspective view illustrating a state before the cartridge PPK is mounted to the tray 110. FIG. 11 illustrates a state in which the cartridge PPK and the tray 110 are shifted to the one longitudinal end portion. Part (a) of FIG. 11 is a view of the tray 110 carrying the cartridge PPK as seen in the inserting direction of the cartridge PPK, (b) is a sectional view taken along a direction of an arrow G3 in (a).

As shown in FIG. 10, the cartridge PPK is mounted to the mounting portion 110*a* of the tray 110 drawn out to the outside position K3, in the direction (arrow Y1 or Y2) perpendicular to the moving direction (arrow D1 or D2) of the tray 110.

As shown in parts (a) of FIGS. 10 and 11, the non-driving side cartridge cover member 125 of the cartridge PPK is provided with a first portion-to-be-regulated 125*b* facing toward the one longitudinal end portion. In addition, a recess 125*d* recessed in the non-driving side cartridge cover member 125 in the direction (arrow D1 in FIG. 10) perpendicular to the longitudinal direction is provided with a second portion-to-be-regulated 125*c* facing toward the other longitudinal end portion.

In the one longitudinal end portion of the tray 110, an inner surface of the mounting portion 110*a* is provided with a first regulating portion 110*b* facing toward the other longitudinal end portion. In the one longitudinal end portion of the tray 110, a projection 110*g* projecting in the direction (arrow D1 in FIG. 10) perpendicular to the longitudinal direction is provided with a second regulating portion 110*c* facing toward the one longitudinal end portion.

When the cartridge PPK is mounted to the mounting portion 110*a* of the tray 110, the first portion-to-be-regulated 125*b* faces the first regulating portion 110*b*. In addition, the second portion-to-be-regulated 125*c* faces the second regulating portion 110*c*. In addition, as shown in part (b) of FIG. 11, the tray 110 is supported in the main assembly 2 of the apparatus, similarly to the Embodiment 1.

Referring to FIGS. 11 and 12, a positioning method for the cartridge PPK and the tray 110 in the main assembly 2 of the apparatus will be described. FIG. 12 illustrates a state in which the cartridge P and the tray 110 are shifted to the other end portion side in the main assembly 2 of the apparatus. Part (a) of FIG. 12 are a view of the tray 110 carrying the cartridge PPK as seen in the inserting direction of the cartridge PPK, (b) is a sectional view in the direction of an arrow F3.

As shown in part (a) of FIG. 11, in the cartridge PPK, a coupling member 4*a* of the drum 4 is urged by a drive outputting portion (unshown) of the main assembly 2 of the apparatus to move in the direction of an arrow E1 in part (a) of FIG. 12. At this time, the first portion-to-be-regulated 125*b* of the non-driving side cartridge cover 125 contacts the first regulating portion 110*b* of the tray 110 so that the position of the cartridge PPK is regulated in the longitudinal direction. Similarly to the Embodiment 1, at this time, the third portion-to-be-regulated 110*d* of the tray 10 contacts the third regulating portion 33*a* of the non-driving side main assembly frame 33 so that the position of the tray 110 is regulated in the longitudinal direction.

That is, the position of the cartridge PPK relative to the main assembly 2 of the apparatus with respect to the longitudinal direction (arrow E1 in FIG. 12) is regulated by way of the tray 110.

Here, the distance between the first portion-to-be-regulated 125*b* and the second portion-to-be-regulated 125*c* is width Q1, and the distance between the first regulating portion 110*b* and the second regulating portion 110*c* is width R11. In order to mount and demount the cartridge PPK on the tray 110 without stress taking tolerances into consideration, the width R11 has to be larger then the width Q11. Then, when the cartridge PPK is at the one end portion side with respect to the longitudinal direction (arrow E1 in FIG. 12), a gap L11 (R11−Q11=L11) which is a difference between the width R11 and the width Q11, between the second portion-to-be-regulated 125*c* and the second regulating portion 110*c*.

In the transportation of the image forming apparatus 1 loaded with the cartridge PPK therein, an impact may be imparted to the image forming apparatus 1 because of the vibration or the like during the transportation, with the result of application of the force to the other end portion sides of the tray 110 and the cartridge PPK (arrow E2 in part (a) of FIG. 12).

At this time, as shown in parts (a) and (b) of FIG. 12, the cartridge PPK moves in the direction of the arrow E2 in FIG. 12 so that the second portion-to-be-regulated 125*c* of the non-driving side cartridge cover 125 contacts to the second regulating portion 110*c* of the tray 10. Then, a gap L11' is produced between the first portion-to-be-regulated 125*b* with first regulating portion 110*b*, so that the cartridge PPK is regulated at the other end portion side with respect to the longitudinal direction (arrow E2 in part (a) of FIG. 12) in the state that it is away by L11'.

In addition, similarly to Embodiment 1, the tray 10 also moves in the direction of the arrow E2, so that the tray 110 is regulated at the other end portion side with respect to the longitudinal direction in the state that it is away by N1'.

The structures of the cartridge PPY and the tray 110, the structures of the cartridge PPM and the tray 110 and the structures of the cartridge PPC and the tray 110 are similar to those of the cartridge PPK and the tray 110.

In this manner, also in this Embodiment 2, as compared with the conventional example (FIGS. 13, 14), the width R11 and the width Q11 can be made smaller than the width R2 and the width Q2, respectively. Therefore, the manufacturing tolerance of the parts with respect to the width R11 and the width Q11 can be made smaller than those with respect to the width R2 and the width Q2, respectively. That is, L11 which is a difference between the width R11 and the width Q11 can be made smaller than the gap L2 which is a difference between the width R2 and the width Q2.

Therefore, similarly to the Embodiment 1, a movement distance of the cartridge PPK in the tray 110 can be reduced from L2 to L11. In the transportation of the image forming apparatus 1, the impact in mounted to the cartridge PPK and the tray 110 can be suppressed because the movement distances of the cartridge PPK and the tray 110 in the main assembly 2 of the apparatus in the longitudinal direction can be reduced. Therefore, the rigidity and therefore the cost can be reduced, which leads to the downsizing and cost reduction of the image forming apparatus 1 and the cartridge PPK.

With the structure of this Embodiment 2, a projection from the cartridge is not provided, and therefore, the cartridge can be further downsized, the package of the cartridge can be downsized, thus improving transportation efficiency.

<Others>

(a) the present invention is not limited to a so-called integral type process cartridge comprising both of the image bearing member 4 for bearing a latent image and the developing means 6 developed the latent image formed on the image bearing member with the developer.

The cartridge P may comprises the image bearing member 4 for bearing a latent image, and an image forming process means other than the developing means.

The cartridge P may be a developing cartridge comprising the developing means for developing the latent image formed on the image bearing member 4 with the developer, and a developer accommodating portion containing the developer.

The cartridge, when mounted to the tray 10, is a coupled combination of the separable type process cartridge and the developing cartridge. In such a case, at least one of the process cartridge and the developing cartridge may be dismountably supported on the tray 35.

The cartridge may be a unit which is dismountably mountable to the main assembly of the apparatus and which is contributable to image forming process for forming an image on the recording material.

(b) in the foregoing embodiments, the image forming apparatus is a full-color electrophotographic image forming apparatus to which four cartridges accommodating different color developers. However, the present invention is not limited to such apparatus, and the number of cartridges is not limited to four and can be selected by one skilled in the art depending on the necessity. For example, the number of the cartridge P may be one, two, three or five or more. The present invention is applicable to a monochromatic image forming apparatus, in which the number of cartridges is one.

(c) in the foregoing embodiments, the tray 10 is moved between the inside position K2 and the outside position K3 linearly in the horizontal direction which is parallel with the installation floor of the main assembly of the apparatus 2. However, the tray 10 in the present invention is not limited to such an example. For example, the tray 10 may be moved in the direction crossing with the longitudinal direction of the drum 4, or may be moved linearly in an angularly upward or downward direction. The tray 10 may be made removable from the main assembly of the apparatus 2 by releasing a stopper.

(d) the intermediary transfer belt unit 11 in the image forming apparatus of foregoing embodiments may be replaced with a recording material feeding transfer belt device for carrying and feeding the recording material S. More particularly, the transfer belt device (recording material feeding and transferring means) in such a case includes a recording material feeding member for carrying and feeding the recording material S to transfer the developer image formed on the drum 4 directly onto the recording material S carried on the feeding member.

(e) the image forming apparatus to which the present invention is applicable is not limited to a printer of the foregoing embodiments. For example, it is applicable to another image forming apparatus such as a copying machine, a facsimile machine or a complex machine having the functions of both of them.

(f) the image forming process of the image forming apparatus is not limited to the electrophotographic process. It may be an electrostatic recording process using a dielectric member for electrostatic recording as the image bearing member, or a magnetic recording process using a magnetic member for magnetic recording.

According to the present invention, the impact applied to the supporting member and to the cartridge during transportation of the image forming apparatus in which the cartridge is mounted can be reduced, and the parts of the supporting member and the cartridge can be simplified. By this, the main assembly of the apparatus and the cartridge can be downsized, and therefore, a cost reduction can be accomplished.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 269259/2012 filed Dec. 10, 2012, which is hereby incorporated by reference.

What is claimed is:

1. An image forming apparatus to which a cartridge is detachably mountable, said image forming apparatus comprising:

a supporting member, carrying the cartridge, movable in directions crossing with a longitudinal direction of the cartridge, between an inside position in which said supporting member is inside a main assembly of said image forming apparatus and an outside position in which said supporting member is outside said main assembly and in which the cartridge is detachably mountable to said main assembly, said supporting member being provided with a first regulating portion capable of being contacted by the cartridge mounted to said supporting member to limit movement of the cartridge in one longitudinal direction and a second regulating portion capable of being contacted by the cartridge mounted to said supporting member to limit movement of the cartridge in the other longitudinal direction;

a third regulating portion provided in said main assembly to be contacted by said supporting member to limit movement of said supporting member in the one longitudinal direction; and a fourth regulating portion provided in said main assembly to be contacted by said supporting member to limit movement of said supporting member in the other longitudinal direction, wherein said first regulating portion and said second regulating portion are disposed at one end portion of said supporting member and outside an image forming region with respect to the longitudinal direction, and said third regulating portion and said fourth regulating portion are disposed at one end portion of said main assembly and outside the image forming region with respect to the longitudinal direction.

2. An apparatus according to claim 1, wherein said main assembly includes a guiding member for supporting and guiding said supporting member between the inside position and the outside position, and wherein said guiding member is provided with said fourth regulating portion.

3. An apparatus according to claim 1, wherein said supporting member includes a mounting portion on which the cartridge is to be mounted, and wherein said second regulating portion includes a recess recessing in said mounting portion in a direction substantially perpendicular to the longitudinal direction.

4. An apparatus according to claim 1, wherein said supporting member includes a mounting portion on which the cartridge is to be mounted, and wherein said second regulating portion includes a projection projecting from said mounting portion in a direction substantially perpendicular to the longitudinal direction.

5. An apparatus according to claim 1, wherein said supporting member is capable of carrying a plurality of such cartridges arranged along a moving direction of said supporting member between the inside position and the outside position.

6. An apparatus according to claim 1, wherein said supporting member is linearly movable in a direction parallel with and angularly upward or angularly downward with respect to a surface on which said main assembly is installed.

7. An apparatus according to claim 1, wherein the cartridge is downwardly mountable to said supporting member, and said supporting member upwardly removably supports the cartridge in the outside position.

8. A cartridge detachably mountable to a supporting member of an image forming apparatus, wherein said image forming apparatus includes said supporting member, carrying said cartridge, moving in directions crossing with a longitudinal direction of said cartridge, between an inside position in which said supporting member is inside a main assembly of said image forming apparatus and an outside position in which said supporting member is outside said main assembly and in which said cartridge is detachably mountable to said main assembly, said supporting member being provided with a first regulating portion capable of being contacted by said cartridge mounted to said supporting member to limit movement of said cartridge in one longitudinal direction and a second regulating portion capable of being contacted by said cartridge mounted to said supporting member to limit movement of said cartridge in the other longitudinal direction, said cartridge comprising:

a first portion-to-be-regulated contactable to the first regulating portion so that movement of said cartridge in the one longitudinal direction is limited, when said cartridge is mounted to the supporting member; and a second portion-to-be-regulated contactable to the second regulating portion so that movement of said cartridge in the other longitudinal direction is limited, when said cartridge is mounted to the supporting member, wherein said first portion-to-be-regulated and said second portion-to-be-regulated are disposed at one end portion of said cartridge and outside the image forming region, with respect to the longitudinal direction.

9. A cartridge according to claim 8, wherein said first portion-to-be-regulated and said second portion-to-be-regulated are provided on a covering member provided at one end portion of said cartridge with respect to the longitudinal direction.

10. A cartridge according to claim 9, wherein said second portion-to-be-regulated is formed by a projection projecting from said covering member in a direction perpendicular to the longitudinal direction.

11. A cartridge according to claim 9, wherein said second portion-to-be-regulated is formed by a recess recessing in said covering member in a direction perpendicular to the longitudinal direction.

12. A cartridge according to claim 9, wherein said cartridge is an integral type process cartridge including an image bearing member for bearing an image, and developing means for developing the latent image with a developer.

13. A cartridge according to claim 9, wherein said cartridge is a separable type process cartridge including an image bearing member for bearing an image, and image forming process means other than developing means for developing the latent image with a developer.

14. A cartridge according to claim 9, wherein said cartridge is a developing cartridge including developing means for developing a latent image formed on an image bearing member, and a developer accommodating portion accommodating the developer to be used by said developing means.

15. A cartridge according to claim 9, wherein said cartridge is a combination of a developing cartridge including developing means for developing a latent image formed on an image bearing member and a developer accommodating portion accommodating the developer to be used by said developing means, and a separable type process cartridge including the image bearing member for bearing the latent image and image forming process means other than said developing means.

16. A cartridge according to claim 12, wherein said image bearing member is an electrophotographic photosensitive member.

17. An image forming apparatus for forming an image on a recording material, comprising:

a cartridge provided with a first portion-to-be-regulated and a second portion-to-be-regulated;

a supporting member, carrying said cartridge, movable in directions crossing with a longitudinal direction of said cartridge, between an inside position in which said supporting member is inside a main assembly of said image forming apparatus and an outside position in which said supporting member is outside said main assembly and in which said cartridge is detachably mountable to said main assembly, said supporting member being provided with a first regulating portion capable of being contacted by said first portion-to-be-regulated to limit movement of said cartridge in one longitudinal direction and a second regulating portion capable of being contacted by said second portion-to-be-regulated to limit movement of said cartridge in the other longitudinal direction;

a third regulating portion for being contacted by said supporting member to limit movement of said supporting member in the one longitudinal direction; and a fourth regulating portion for being contacted by said supporting member to limit movement of said supporting member in the other longitudinal direction, wherein said first regulating portion and said second regulating portion are disposed at one end portion of said supporting member and outside an image forming region with respect to the longitudinal direction, and said third regulating portion and said fourth regulating portion are disposed at one end portion of said main assembly and outside the image forming region with respect to the longitudinal direction.

18. An apparatus according to claim 17, wherein said main assembly includes a guiding member for supporting and guiding said supporting member between the inside position and the outside position, and wherein said guiding member is provided with said fourth regulating portion.

19. An apparatus according to claim 17, wherein said supporting member includes a mounting portion on which said cartridge is to be mounted, and wherein said second regulating portion includes a recess recessing in said mounting portion in a direction substantially perpendicular to the longitudinal direction.

20. An apparatus according to claim 17, wherein said supporting member includes a mounting portion on which said cartridge is to be mounted, and wherein said second regulating portion includes a projection projecting from said mounting portion in a direction substantially perpendicular to the longitudinal direction.

21. An apparatus according to claim 17, wherein said supporting member is capable of carrying a plurality of such cartridges arranged along a moving direction of said supporting member between the inside position and the outside position.

22. An apparatus according to claim 17, wherein said supporting member is linearly movable in a direction parallel with and angularly upward or angularly downward with respect to a surface on which said main assembly of the apparatus is installed.

23. An apparatus according to claim 17, wherein said cartridge is downwardly mountable to said supporting member, and said supporting member upwardly removably supports said cartridge in the outside position.

24. An apparatus according to claim 17, wherein said first portion-to-be-regulated and said second portion-to-be-regulated are provided on a covering member provided at one end portion of said cartridge with respect to the longitudinal direction.

25. An apparatus according to claim 24, wherein said second portion-to-be-regulated is formed by a projection projecting from said covering member in a direction perpendicular to the longitudinal direction.

26. An apparatus according to claim 24, wherein said second portion-to-be-regulated is formed by a recess recessing in said covering member in a direction perpendicular to the longitudinal direction.

27. An apparatus according to claim 17, wherein said cartridge is an integral type process cartridge including an image bearing member for bearing an image, and developing means for developing the latent image with a developer.

28. An apparatus according to claim 17, wherein said cartridge is a separable type process cartridge including an image bearing member for bearing an image, and image forming process means other than developing means for developing the latent image with a developer.

29. An apparatus according to claim 17, wherein said cartridge is a developing cartridge including developing means for developing a latent image formed on an image bearing member, and a developer accommodating portion accommodating the developer to be used by said developing means.

30. An apparatus according to claim 17, wherein said cartridge is a combination of a developing cartridge including developing means for developing a latent image formed on an image bearing member and a developer accommodating portion accommodating the developer to be used by said developing means, and a separable type process cartridge including said image bearing member for bearing the latent image and image forming process means other than said developing means.

31. An apparatus according to claim 27, wherein said image bearing member is an electrophotographic photosensitive member.

32. An apparatus according to claim 1, wherein said supporting member carries a plurality of such cartridges, which are arranged along the movable direction of said supporting member.

33. An apparatus according to claim 17, wherein said supporting member carries a polarity of such cartridges, which are arranged along the movable direction of said supporting member.

* * * * *